US009194643B2

(12) United States Patent
Biafore, Jr. et al.

(10) Patent No.: US 9,194,643 B2
(45) Date of Patent: Nov. 24, 2015

(54) CROSSBOW

(71) Applicant: Eastman Outdoors, Inc., Flushing, MI (US)

(72) Inventors: John J. Biafore, Jr., Grand Blanc, MI (US); Jeffrey Allan Pestrue, Saint Louis, MI (US)

(73) Assignee: Eastman Outdoors, Inc., Flushing, MI (US)

( * ) Notice: Subject to any disclaimer, the term of this patent is extended or adjusted under 35 U.S.C. 154(b) by 0 days.

(21) Appl. No.: 14/174,345

(22) Filed: Feb. 6, 2014

(65) Prior Publication Data

US 2014/0150763 A1 Jun. 5, 2014

Related U.S. Application Data

(60) Division of application No. 13/705,976, filed on Dec. 5, 2012, now Pat. No. 8,701,642, which is a continuation-in-part of application No. 13/399,756, filed on Feb. 17, 2012, now abandoned.

(60) Provisional application No. 61/711,860, filed on Oct. 10, 2012.

(51) Int. Cl.
*F41B 5/12* (2006.01)
*F41B 5/14* (2006.01)

(52) U.S. Cl.
CPC . *F41B 5/12* (2013.01); *F41B 5/123* (2013.01); *F41B 5/1403* (2013.01); *F41B 5/1442* (2013.01)

(58) Field of Classification Search
USPC ..... 124/25, 88
See application file for complete search history.

(56) References Cited

U.S. PATENT DOCUMENTS

| | | | |
|---|---|---|---|
| 3,224,427 | A | 12/1965 | Ronan |
| 4,594,994 | A | 6/1986 | Williams |
| 4,693,228 | A | 9/1987 | Simonds et al. |
| 4,722,318 | A | 2/1988 | Yankey |
| 4,895,061 | A | 1/1990 | Baricos et al. |
| 5,062,406 | A | 11/1991 | Robertson |
| 5,119,797 | A | 6/1992 | Anderson |
| 5,215,069 | A | 6/1993 | Liu |
| 5,544,641 | A | 8/1996 | Jenn |
| 6,155,243 | A | 12/2000 | Gallops, Jr. |
| 6,901,921 | B1 | 6/2005 | Barnett |
| 6,925,744 | B2 | 8/2005 | Kincel |

(Continued)

FOREIGN PATENT DOCUMENTS

| | | |
|---|---|---|
| FR | 422154 A | 3/1911 |
| FR | 2765959 | 1/1999 |

OTHER PUBLICATIONS

International Search Report for PCT/US2013/025768, dated Apr. 19, 2013.

(Continued)

*Primary Examiner* — John Ricci
(74) *Attorney, Agent, or Firm* — Kristin L. Murphy; Brooks Kushman, P.C.

(57) ABSTRACT

A crossbow is provided which has forward and rearward ends, a firing assembly having a finger-pull mechanism, and a butt member having a rear end. The crossbow has a length of pull that is positioned forward of the rearward end of the crossbow, where the length of pull is defined as a distance between the finger-pull mechanism and the rear end of the butt member.

20 Claims, 19 Drawing Sheets

(56) References Cited

U.S. PATENT DOCUMENTS

| | | | |
|---|---|---|---|
| 7,178,514 | B2 | 2/2007 | Chang |
| 7,281,534 | B2 | 10/2007 | Bednar |
| 7,363,740 | B2 | 4/2008 | Kincel |
| 7,677,233 | B2 | 3/2010 | Bednar |
| 7,810,480 | B2 | 10/2010 | Shepley et al. |
| 7,823,572 | B2 | 11/2010 | Anderson |
| 7,997,258 | B2 | 8/2011 | Shepley et al. |
| 8,033,275 | B2 | 10/2011 | Bednar et al. |
| 2006/0137670 | A1 | 6/2006 | Shaffer |
| 2008/0000463 | A1 | 1/2008 | Holmberg |
| 2008/0127956 | A1 | 6/2008 | Bednar et al. |
| 2011/0203561 | A1 | 8/2011 | Shaffer et al. |

OTHER PUBLICATIONS

PCT International Search Report and Written Opinion dated Aug. 19, 2014 for PCT/US2013/025768.

Supplemental European Search Report dated Sep. 18, 2015 for EP13749751.7-1655/2815200.

CROSSBOW

CROSS-REFERENCE AND INCORPORATION BY REFERENCE

This patent application is a Divisional of U.S. patent application Ser. No. 13/705,976, filed Dec. 5, 2012, and entitled "Crossbow" which, in turn, is a Continuation-in-Part of U.S. patent application Ser. No. 13/399,756, filed Feb. 17, 2012, and entitled "Accessory Mount For A Crossbow" and which claims the benefit of domestic priority of U.S. Provisional Application Ser. No. 61/711,860, filed Oct. 10, 2012, and entitled "Crossbow". U.S. patent application Ser. No. 13/705,976, U.S. patent application Ser. No. 13/399,756 and U.S. Provisional Patent Application Ser. No. 61/711,860 are hereby incorporated by reference in their entireties.

FIELD OF THE INVENTION

The invention relates to crossbows. More particularly, the invention relates to crossbows which provide more area for mounting accessories thereto, which provide an increased power stroke without increasing a forward weight of the crossbow, and which provide better balance.

BACKGROUND OF THE INVENTION

The use of crossbows for hunting and target practice has increased in recent years. For some people, such as those who are elderly, disabled or young, using a traditional bow or a compound bow may be too physically strenuous. Therefore, crossbows offer these individuals an opportunity to hunt or shoot. For others, shooting with crossbows may offer variety over using only a traditional bow, or they may simply enjoy using a crossbow.

With this recent increase in the use of crossbows, there has also been a recent boom in the number and types of crossbow accessories that are being manufactured and sold. Typical crossbow users want to enjoy the benefits of as many of these accessories as they can, however, the crossbows of the prior art do not provide enough areas for users to mount all of their desired accessories to their crossbows because the crossbows of the prior art provide only limited mounting areas due to the configuration and operation thereof.

Currently, crossbows of the prior art allow for sighting devices, e.g., a scope or a sight, to be mounted on a sight bridge which is secured above, and extends slightly forward of, a trigger box of a firing assembly of the crossbow. The trigger box of prior art crossbows is provided at a rearward upper area of the crossbow. Due to the short length of the sight bridge and the typical size of the sighting device, no other accessories can logistically be mounted on the sight bridge. Crossbows of the prior art also allow for accessories, such as a forearm, a foregrip and/or a quiver, to be mounted to a lower surface of the crossbow forward of a finger-pull mechanism of the firing assembly. Due to the limited space provided on the lower surface of the crossbow forward of the finger-pull mechanism, accessories other than a forearm, a foregrip and/or a quiver are not typically mounted in this area.

The remaining areas of the crossbow are not designed to have accessories mounted thereto because of the configuration and operation of the crossbow. For example, crossbows of the prior art do not have accessories mounted to a forward upper area thereof because the accessories would likely impede the operation of the crossbow by, for example, affecting the path of a bolt as it is fired from the crossbow, affecting the movement of the bowstring between a rearward cocked position and a forward rest position, affecting the movement of the limbs, affecting the movement of the power cables, or blocking the view of the sighting device.

It is also a desire to minimize a forward weight of crossbows. The forward weight of a crossbow is defined herein as a weight of the crossbow forward of a grip which is used to hold the crossbow while firing with the same hand. Similarly, a rearward weight of a crossbow is defined herein as a weight of the crossbow rearward of the grip. As the grip is where the crossbow is held, the position of the grip generally acts as a fulcrum point of the crossbow. The rearward weight of a crossbow is typically not hard for a user to support because a rear end of the crossbow is typically supported against a user's body when the crossbow is aimed and fired. However, the forward weight of the crossbow is not supported by anything and, therefore, the forward weight is the portion of the weight of the crossbow that is more likely to have a negative effect on a user's ability to support and hold steady the crossbow in a desired position for an extended period of time. Thus, it would be desirable to have a crossbow which has a center of gravity which is rearward of the grip or, at a minimum, be positioned only slightly forward of the grip.

Unfortunately, one of the inherent design setbacks with traditional crossbows is that these crossbows have centers of gravity which are positioned well forward of the grip as the riser, the limbs, and much of the barrel are positioned forward of the grip, such that they are included in the forward weight of the crossbows, thus making traditional crossbows excessively front-heavy. This is not desirable because a front-heavy crossbow will be harder for those utilizing the crossbow to aim and hold the crossbow in a steady position for an extended period of time, which may be necessary in order for the user to achieve an accurate shot, especially if the user is a hunter who may need to keep the crossbow in a ready position for an extended period of time while waiting for a target to approach.

It is also a desire to increase the strength of crossbows, e.g., to provide a crossbow that can hold an increased amount of energy compared to crossbows of the prior art. The amount of energy that a crossbow can hold is approximately equal to its draw length (the distance between the bowstring's position at rest and its position when cocked—also commonly referred to as a crossbow's power stroke) times its draw weight (the amount of force required to draw the crossbow, namely the amount of force required to move the bowstring from its rest position to its cocked position), divided by two. Thus, in order for crossbows to have increased strengths, the draw length and/or the draw weight must be increased.

In order to make crossbows more usable and ergonomic for a myriad of different sized individuals, it is not always desirable to increase the draw weight of the crossbow as an increase in draw weight will likely lead to a number of people having to struggle with the ability to cock the bowstring and ultimately with another number of people simply being unable to cock the bowstring at all. Thus, a more preferred manner of increasing the strength of a crossbow is achieved by increasing the draw length of the crossbow.

However, increasing the draw length of the crossbow has its own inherent disadvantages. In direct trigger crossbows (those where the firing assembly has the action, e.g., the string latch, in direct alignment with the finger-pull mechanism), an increase in the draw length of the crossbow necessarily means adding more weight to the forward weight of the crossbow and, furthermore, adding that weight distal to the fulcrum point, namely the grip, of the crossbow (as the finger-pull mechanism is always positioned slightly forward of the grip), thereby making this weight even harder to support than weight added proximate to the fulcrum point. By adding forward weight to the crossbow, the center of gravity of the crossbow also necessarily moves further forward of the grip. In order to combat the inherent front-heaviness of crossbows, various efforts exist in the prior art to try and solve this problem.

For instance, U.S. Pat. No. 7,677,233 to Bednar discloses a support rod which is pivotally connected to the crossbow forward of the grip to allow the user to support the forward weight of the crossbow while waiting for a target to approach. While such support rods do provide advantages, the use of such support rods can have their own disadvantages such that some users might prefer to not use them. For instance, the support rods may become cumbersome or impractical to use in the location where the user is shooting.

In another example, United States Patent Application Publication No. US 2011/0203561 to Shaffer et al. discloses a crossbow having limbs formed from carbon fiber, which was known in the prior art, but also has a riser formed from carbon fiber. The use of carbon fiber in both the limbs and the riser reduces the weight at the front of the crossbow. While forming the riser of a carbon fiber material would certainly lighten the overall weight of the crossbow, the resultant crossbow is still provided with substantial forward weight which must be supported by the user.

Another example is the creation of a reverse-draw crossbow which moves the positioning of the riser and the limbs to proximate the grip. Reverse-draw crossbows thus typically do not have as much forward weight as traditional crossbows or, at a minimum, have a higher percentage of the forward weight thereof being positioned proximate to, rather than distal to, the grip. Thus, reverse-draw crossbows also inherently move the center of gravity closer to the grip, and possibly even rearward of the grip. Reverse-draw crossbows, however, typically aren't as powerful as traditional crossbows. While reverse-draw crossbows can be modified to make them as powerful as traditional crossbows, the reverse-draw crossbows then typically become big and bulky, which is undesirable.

In other examples, crossbow manufacturers have reduced the forward weight of crossbows by providing the crossbows with shortened barrels and/or by shortening the overall length of the crossbows by using bullpup stocks (those where the firing assembly has the action, e.g., the string latch, provided rearward of the finger-pull mechanism). Thus, each of these also necessarily have moved the center of gravity of the crossbow rearward or toward the user.

While shortened barrels aid in reducing the forward weight of the crossbows and thus aid in moving the center of gravity of the crossbows toward the user, crossbows with shortened barrels come with their own disadvantages. More specifically, shortened barrels generally cause the crossbow to have a reduced draw length which, as explained hereinabove, is undesirable as the crossbow will then not be able to hold as much energy as may be desired (unless the draw weight is increased). A reduction in energy of the crossbow has disadvantages as this reduction in energy may result in the crossbow not being able to cause a bolt fired therefrom to provide a humane quick kill of the target, but rather may only injure the target or cause a slow, inhumane kill of the target.

Bullpup stocks generally allow for a reduction in the overall length of the crossbow because the string latch is moved closer to the user. This movement of the string latch, and thus the necessary rearward movement of associated parts of the firing assembly, results in a reduction in the forward weight (and an increase in the rearward weight) of the crossbow. Therefore, the center of gravity of the crossbow is likewise moved rearward, i.e., toward the user, thereby making the crossbow easier for a user to aim and shoot. Bullpup stocks also achieve this desired effect while maintaining the same length of pull as in crossbows having a direct trigger.

Length of pull of a crossbow is defined as the distance between a finger-pull mechanism of a firing assembly and a rear portion of the crossbow that contacts a user's body, namely a butt end of all prior art crossbows. Crossbows of the prior art all typically have a length of pull of approximately fourteen (14) inches plus or minus one (1) inch. It has been found that a substantial population of typical crossbow users require a length of pull distance of approximately thirteen (13) to fifteen (15) inches to allow the user to comfortably position the butt end of the crossbow against a front of their bodies proximate to their shoulder and to use a hand to support the crossbow at the grip proximate the finger-pull mechanism with one of their fingers of that hand (typically their index finger) being in position to pull the finger-pull mechanism.

Crossbows of the prior art are either outfitted with a butt end that is fixed in position or a butt end that can be rearward extended from a base position. In the case of the former, the crossbow manufacturer determines the length of pull for that crossbow, with the understanding that that particular length of pull will not be ideal for all users, e.g., those who have shorter or longer arms than normal. In the case of the latter, the crossbow manufacturer further sets a minimum length of pull for that crossbow, but provides the crossbow with a telescoping butt member such that the length of pull for that crossbow can be increased as desired to within the limits of the telescoping butt member. Telescoping butt members typically allow for a user to add an additional three (3) to four (4) inches to the minimum length of pull of the crossbow. Padding or cushioning can also be added to the butt end which further increases the length of the crossbow.

Due to the typical lengths of pull of prior art crossbows, bullpup stocks typically provide a distance of two (2) to five (5) inches from the finger-pull mechanism to the string latch, with a maximum known distance of six (6) inches. The reason this distance is limited to six (6) inches is twofold. First, the sighting device is mounted on top of a trigger box which houses the string latch. If the string latch is moved even further rearward of the finger-pull mechanism, sufficient space is not provided for the user to position his/her eye against an eyepiece of the sighting device. Second, the position of the user's head/face could come into contact with the trigger box or the cocked bowstring (and its travel path when it is released from its cocked position).

Thus, in view of the foregoing, there remains a need for a crossbow which provides more areas for mounting of accessories compared to crossbows of the prior art, and which provides for greater draw length compared to crossbows of the prior art, and which provides for a crossbow having a forward weight which allows a user to support the crossbow at the grip for extended periods of time. The present invention provides such a crossbow.

SUMMARY OF THE INVENTION

A first preferred embodiment of the invention provides a crossbow having a beam mounted to a frame of the crossbow forward of a rest position of a bowstring. The beam extends rearwardly over the rest position of the bowstring, over a barrel of the crossbow, and is secured to a trigger box of a firing assembly of the crossbow. The beam provides the crossbow with additional area for mounting crossbow accessories compared to prior art crossbows.

The crossbow also provides a greater power stroke compared to crossbows of similar construction as the crossbow is provided with a bullpup stock that has a bullpup distance (distance from finger-pull mechanism to a string latch of the firing assembly) of more than six inches. Heretofore, crossbows were not outfitted with bullpup distances of more than six inches because the user would not then be able to utilize a sighting device mounted above the trigger box. However, as the beam provides for greater area to mount the sighting device than that provided for on prior art crossbows, the sighting device can be positioned forward of positions allowed for by prior art crossbows, thereby allowing the user to use the sighting device despite the crossbow having a bullpup distance of more than six inches. The bullpup distance of the crossbow also provides for a crossbow which does not negatively affect, and which may improve, the positioning of the center of gravity of the crossbow.

The crossbow further provides for a greater range of length of pull (distance from the string latch of the firing assembly to a butt end of the crossbow) of the crossbow such that the crossbow can be comfortably used by a greater range of individuals than can prior art crossbows.

A second preferred embodiment of the invention provides a crossbow having an elongated rearward member which adds to the rearward weight of the crossbow and, thus, necessarily moves the center of gravity of the crossbow rearward. When the crossbow is used, the elongated rearward member extends further rearward than does a butt member of the crossbow, which is typically positioned against a front of a user's torso at or proximate to a shoulder. The elongated rearward member is configured to extend past a user's shoulder and a bottom surface thereof is configured to rest or sit upon the user's shoulder, thereby providing the user with greater balance and support of the entire weight of the crossbow, thereby alleviating the amount of weight of the crossbow that must be supported by the hand on the grip of the crossbow.

A third preferred embodiment of the invention provides a crossbow having a bullpup distance of greater than eight inches, which allows for the forward weight of the crossbow to be reduced (and thus the rearward weight of the crossbow to be increased) such that the center of gravity of the crossbow will be moved rearwardly of the center of gravity of the first embodiment of the crossbow (when the crossbows have the same overall length), or which allows for the power stroke of the crossbow to be increased if the overall length of the crossbow is increased compared to the crossbow of the first embodiment.

One or more of the preferred embodiments provides a crossbow having a frame; first and second limbs secured to the frame; a bowstring which extends between the first and second limbs, the bowstring being configured to move between a forward rest position and a rearward cocked position; and a beam secured to the frame forward of the forward rest position of the bowstring, the beam configured to allow one or more accessories to be mounted thereon.

One or more of the preferred embodiments provides a beam for a crossbow, the crossbow having a frame, first and second limbs secured to the frame, and a bowstring extending between the first and second limbs and which is movable between a forward rest position and a rearward cocked position, the beam having a base configured to be secured to the frame forward of the forward rest position of the bowstring; and an extension connected to the base, the extension configured to allow one or more accessories to be mounted thereon.

One or more of the preferred embodiments provides a crossbow having a frame; first and second limbs secured to the frame; a bowstring which extends between the first and second limbs, the bowstring being configured to move between a forward rest position and a rearward cocked position; and a beam which is secured to the frame, the beam being positioned to extend over the forward rest position of the bowstring, the beam being configured to allow one or more accessories to be mounted thereon.

One or more of the preferred embodiments provides a crossbow having a frame having a rear end; a firing assembly associated with the frame, the firing assembly having a finger-pull mechanism; and a butt member being associated with the frame, the butt member having a rear end which is configured to abut a front of a shoulder of a user, the butt member positioned between the finger-pull mechanism and the rear end of the frame.

One or more of the preferred embodiments provides a crossbow having a forward end and a rearward end; a firing assembly having a finger-pull mechanism; and a butt member having a rear end, wherein a distance between the finger-pull mechanism and the rear end of the butt member defines a length of pull of the crossbow, and wherein the length of pull of the crossbow is positioned forward of the rearward end of the crossbow.

One or more of the preferred embodiments provides a crossbow having a frame having a rear end; first and second limbs secured to the frame; and a bowstring which extends between the first and second limbs, the bowstring being configured to move between a forward rest position and a rearward cocked position, wherein the rear end of the frame is configured to be positioned rearward of a front of a shoulder of a user.

One or more of the preferred embodiments provides a method aiming a crossbow, where the method comprises the steps of a) providing a crossbow having a forward end, a rearward end, and a firing assembly, the firing assembly having a finger-pull mechanism which is provided between the forward and rearward ends of the crossbow; b) positioning the rear end of the crossbow rearward of a front of a shoulder of a user who is aiming the crossbow; and c) manipulating the crossbow to position the forward end of the crossbow in a desired direction.

One or more of the preferred embodiments provides a crossbow having a frame configured to provide a rail on which a bolt is supported; first and second limbs secured to the frame; a bowstring which extends between the first and second limbs, the bowstring being configured to move between a forward rest position and a rearward cocked position; and a bolt retainer which is configured to downwardly bias the bolt in position along the rail of the frame forward of the forward rest position of the bowstring.

One or more of the preferred embodiments provides a crossbow having a frame having a lower surface; a firing assembly associated with the frame, the firing assembly having a finger-pull mechanism; and a mounting rail associated with the lower surface of the frame rearward of the finger-pull mechanism, the mounting rail being configured to allow one or more accessories to be mounted thereto.

One or more of the preferred embodiments provides a crossbow having a frame having a forward end and a rearward end; and a firing assembly associated with the frame, the firing assembly having a finger-pull mechanism, the finger-pull mechanism positioned at, or forward of, a midway point of the frame between the forward end and the rearward end.

One or more of the preferred embodiments provides a crossbow having a frame; a bowstring configured to move between a forward rest position and a rearward cocked position; and a firing assembly operatively associated with the frame, the firing assembly having a finger-pull mechanism and a string latch, the string latch configured to retain the bowstring in the rearward cocked position, the string latch positioned more than six inches rearward of the finger-pull mechanism.

One or more of the preferred embodiments provides a crossbow having a frame having a forward end and a rear end; a firing assembly which is operatively associated with the frame, the firing assembly having a string latch, the string latch positioned between the forward and rear ends of the frame; and a sighting device having an eyepiece, the sighting device connected to the crossbow in a manner which provides that the eyepiece is positioned in alignment with, or forward of, the string latch.

One or more of the preferred embodiments provides a crossbow having a frame having a rearward end portion which is configured to abut against a user when the crossbow is aimed and fired; a bowstring configured to move between a forward rest position and a rearward cocked position; and a firing assembly operatively associated with the frame, the firing assembly having a finger-pull mechanism and a string latch, the string latch configured to retain the bowstring in the rearward cocked position, the string latch being positioned rearward of the finger-pull mechanism, wherein a bull-pup distance of the crossbow is defined as a distance the string latch is positioned rearward of the finger-pull mechanism, wherein a length of pull distance of the crossbow is defined as a distance between the finger-pull mechanism and the rearward end portion of the frame, wherein a ratio of length of pull distance of the crossbow to bull-pup distance of the crossbow is two-to-one or less.

One or more of the preferred embodiments provides a crossbow having an elongated frame having a forward end portion, and a foot stirrup secured to the forward end portion, the foot stirrup having first and second portions, the first portion being configured to extend forward of the elongated frame to the second portion, the second portion being configured to extend downwardly from the first portion, whereby the downwardly extending second portion of the foot stirrup provides increased surface area to stabilize the crossbow during a cocking operation, and whereby the downwardly extending second portion of the foot stirrup acts is configured to act as a bipod when the crossbow is aimed and fired.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
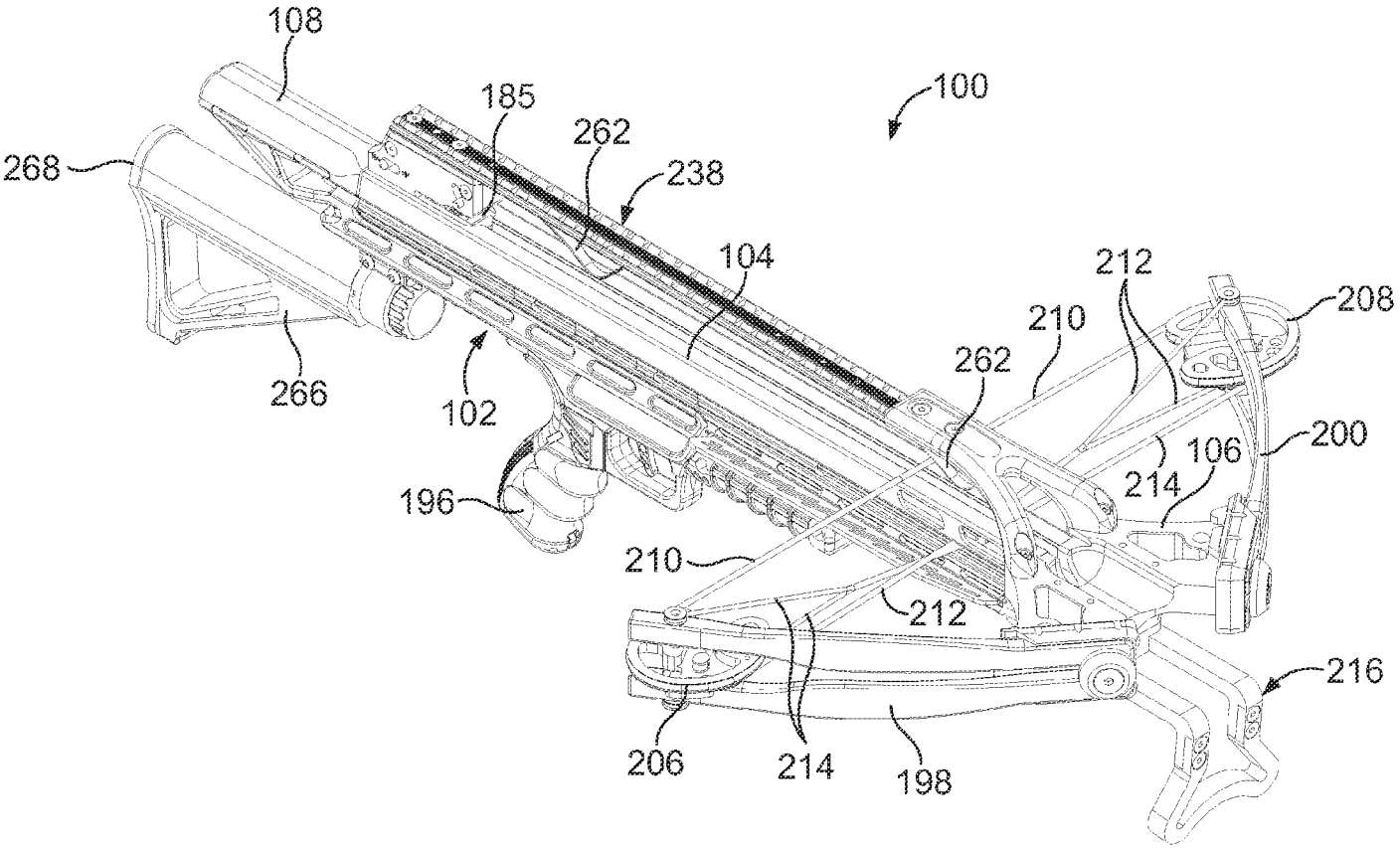
FIG. 1 is a perspective view of a first preferred embodiment of a crossbow of the invention with the bowstring in a forward rest position.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention provides for improvements in crossbows. A first embodiment of a crossbow 100 of the present invention is described in relation to FIGS. 1-28. A second embodiment of a crossbow 300 of the present invention is described in relation to FIGS. 29 and 30. A third embodiment of a crossbow 500 of the present invention is described in relation to FIGS. 31 and 32. Like elements are denoted with like reference numerals with the first embodiment being in the one and two hundreds, the second embodiment being in the three and four hundreds, and the third embodiment being in the five and six hundreds.

As referenced throughout, the directions "rearward" and "forward" are made with reference to the direction of travel of a bolt that is fired from the crossbows 100, 300, 500. More specifically, the bolt moves in a forward direction as it exits a forward end of the crossbow 100, 300, 500.

Attention is now directed to FIGS. 1-28 and the first embodiment of the crossbow 100.

Figure 2:
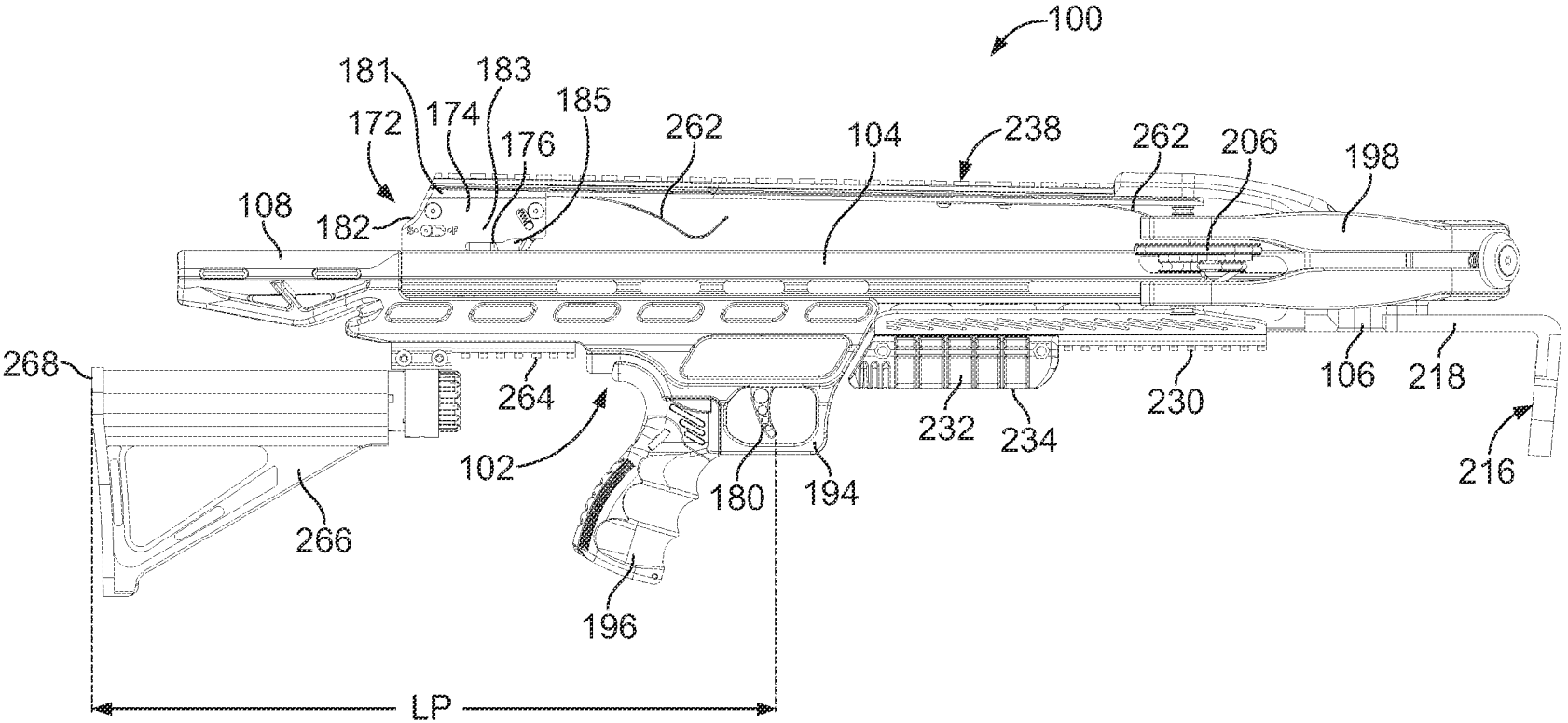
FIG. 2 is a right side view of the crossbow of FIG. 1.
Figure 4:
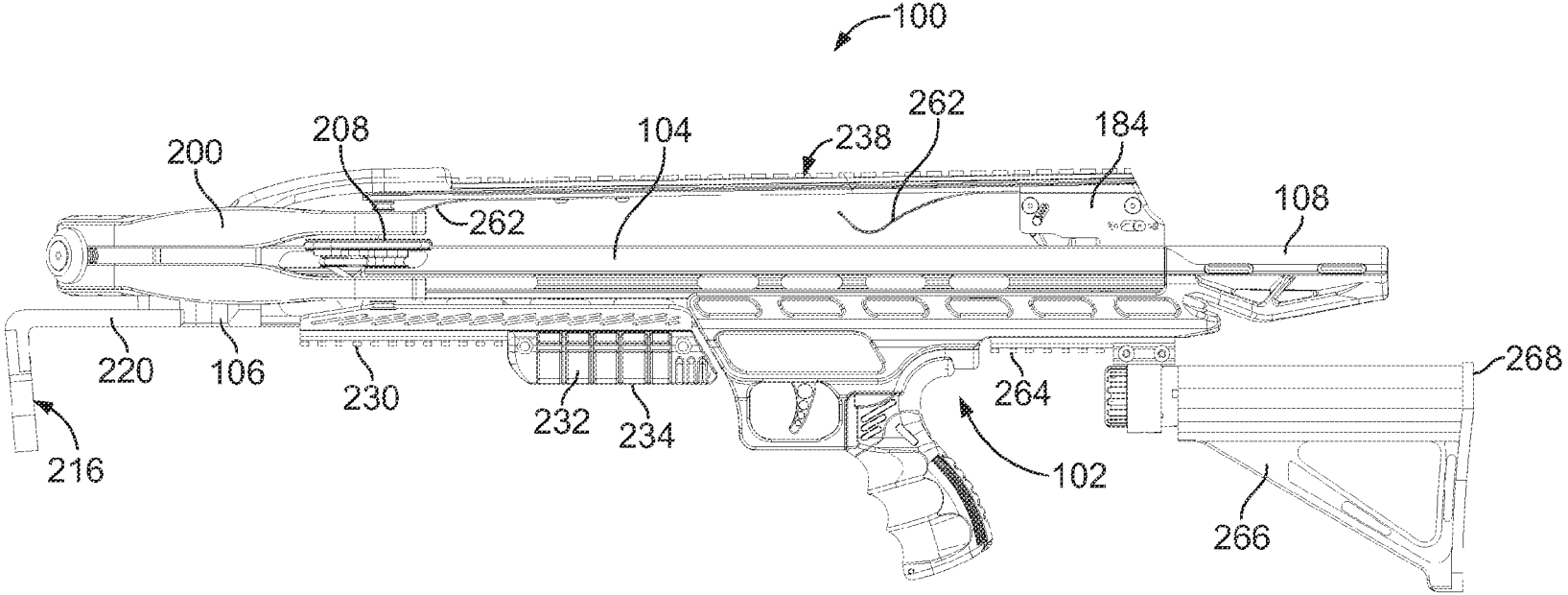
FIG. 4 is a left side view of the crossbow of FIG. 1.
Figure 5:
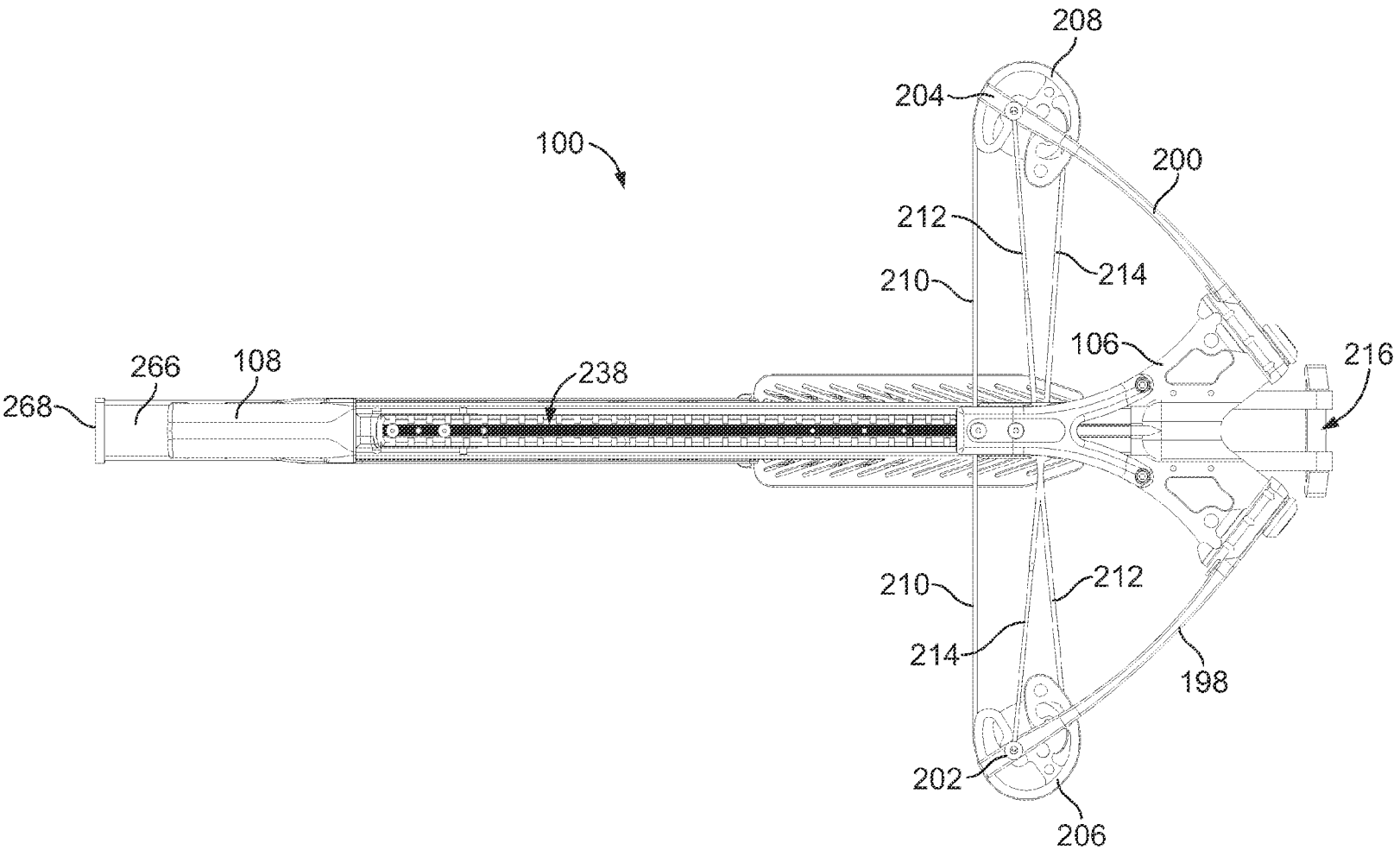
FIG. 5 is top view of the crossbow of FIG. 1.
Figure 6:
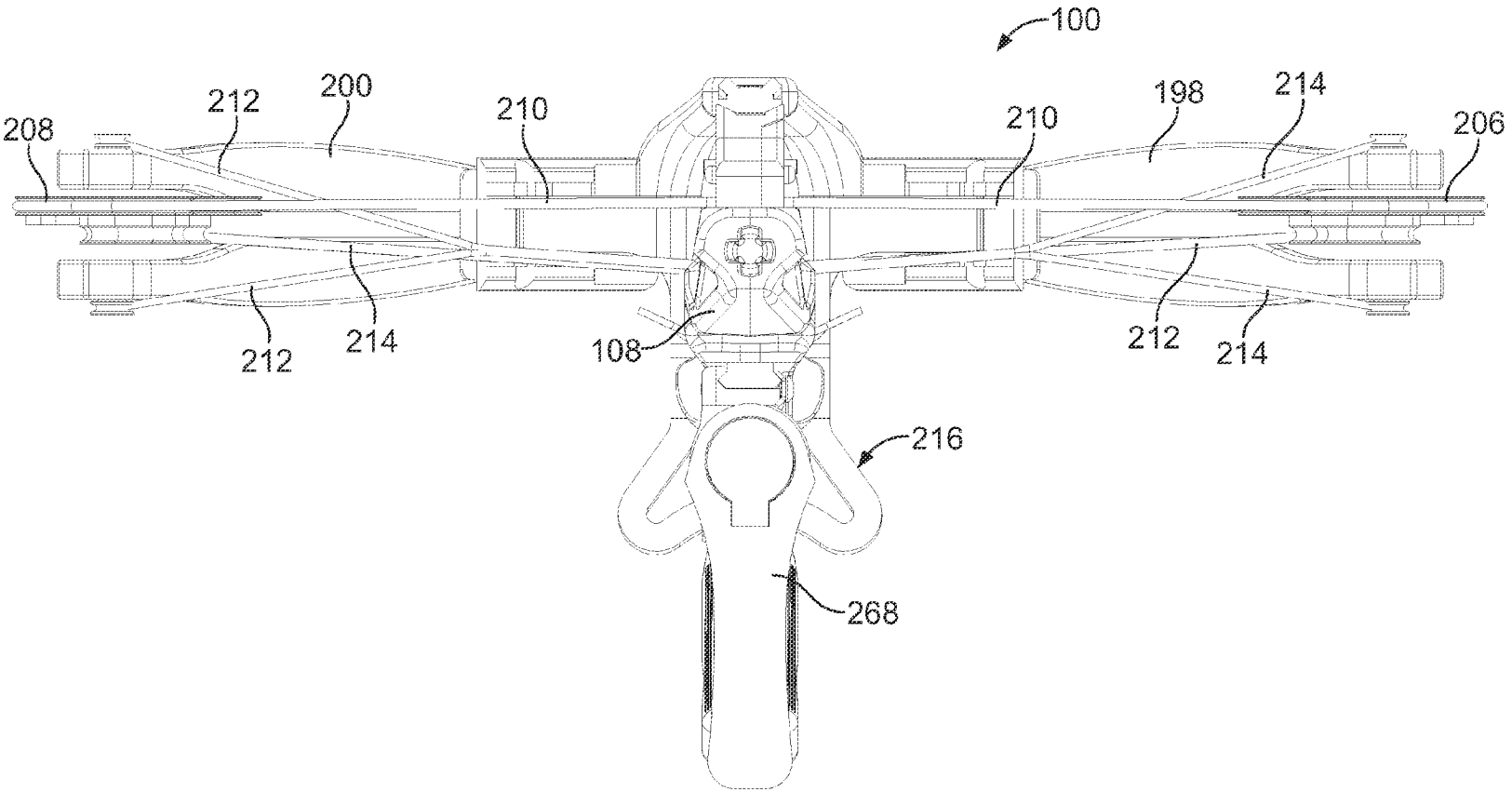
FIG. 6 is a rear view of the crossbow of FIG. 1.
Figure 7:
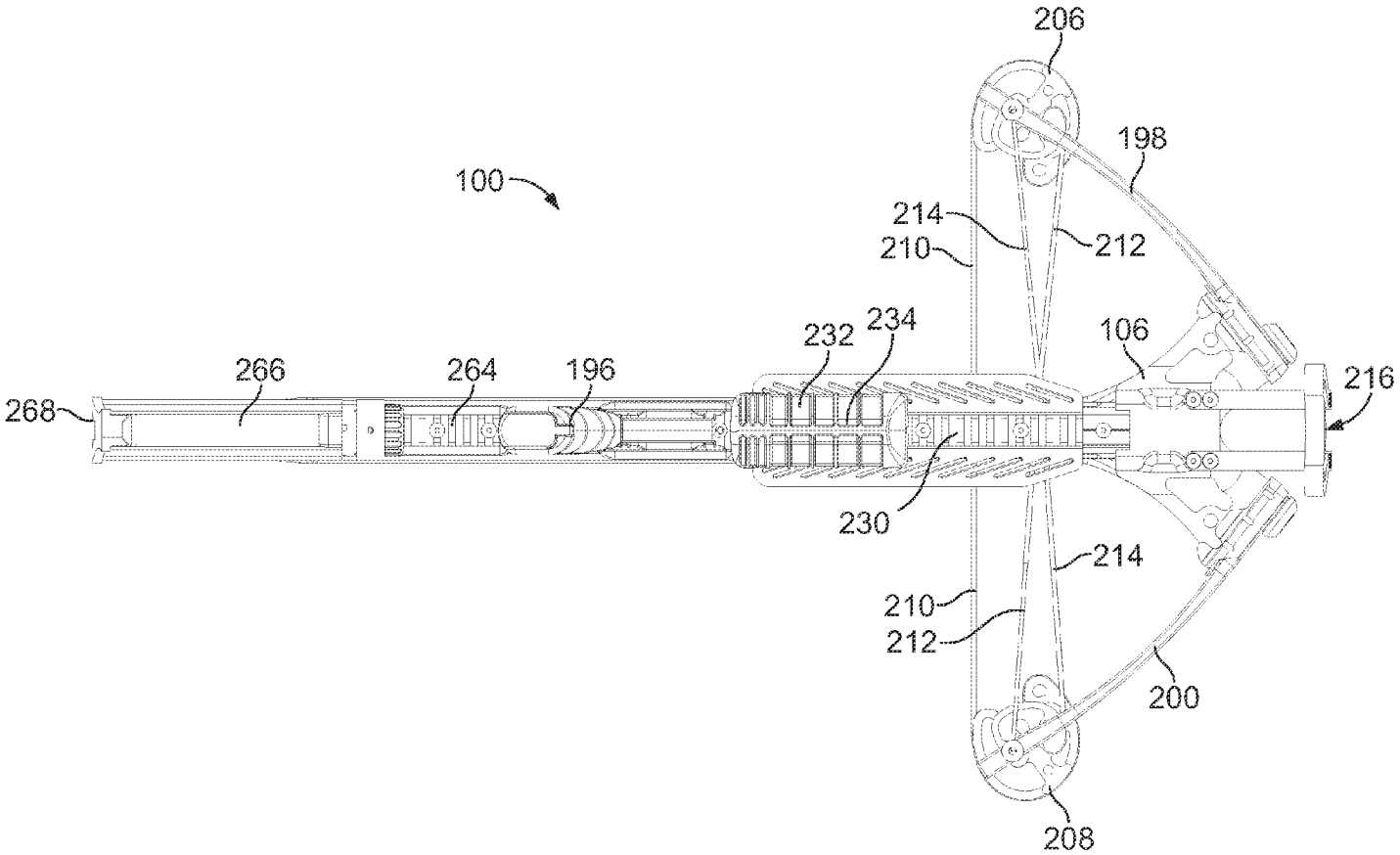
FIG. 7 is bottom view of the crossbow of FIG. 1.
Figure 8:
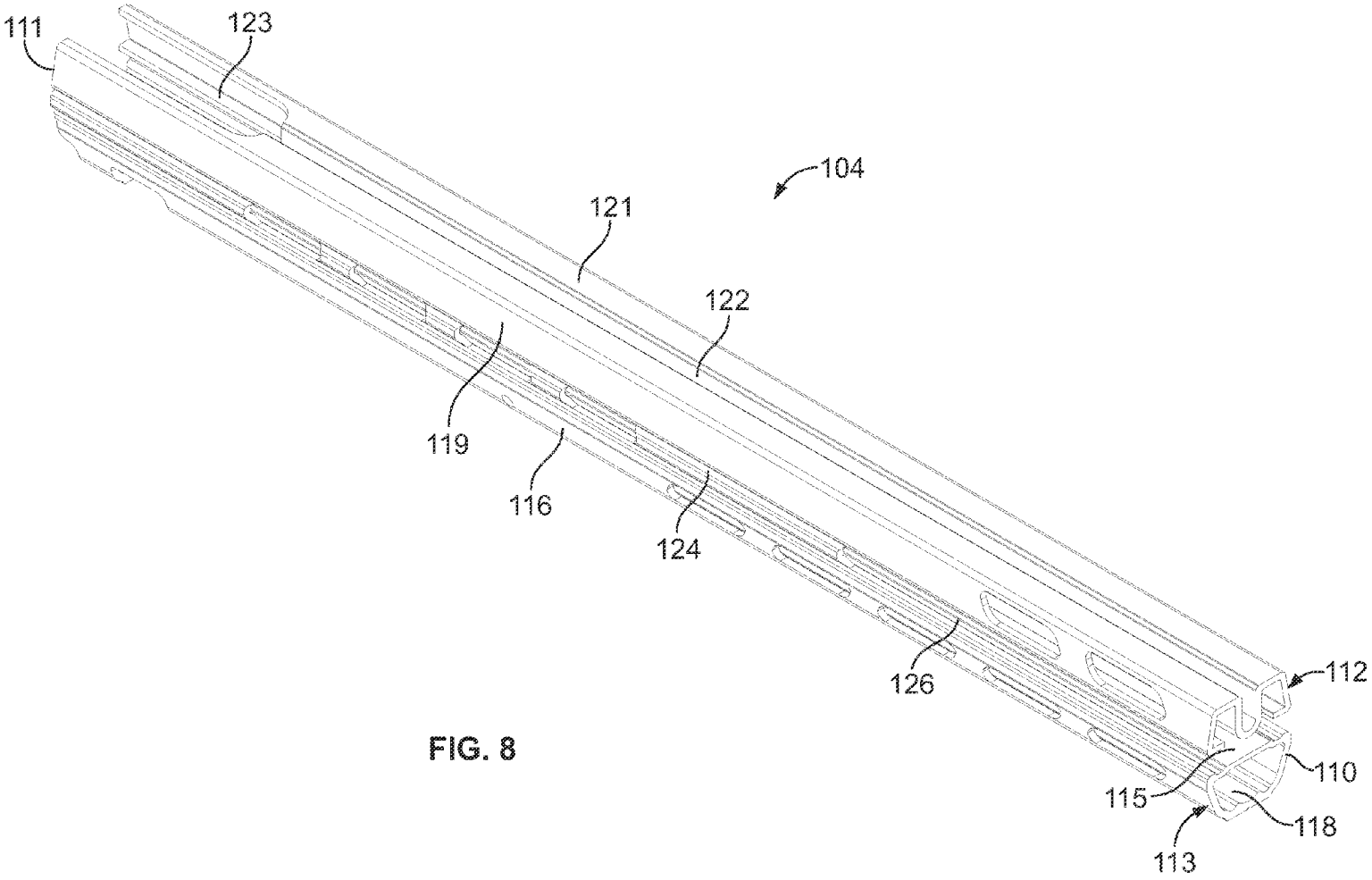
FIG. 8 is a perspective view of a barrel of the crossbow of FIG. 1.
Figure 9:
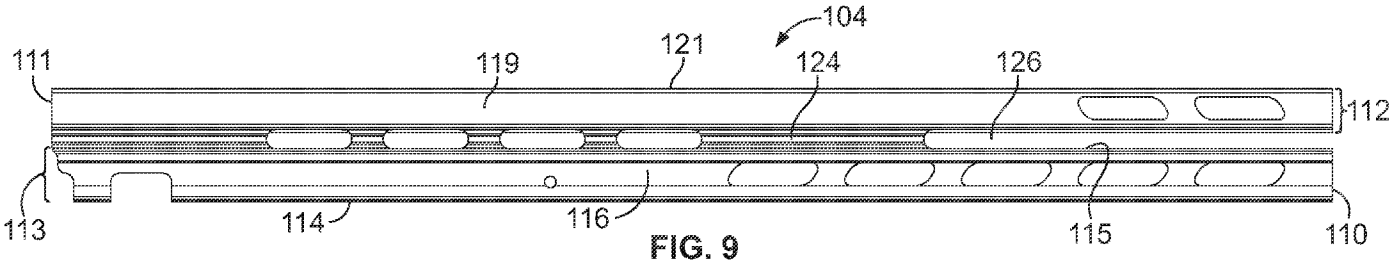
FIG. 9 is a right side view of the barrel of FIG. 8.
Figure 10:
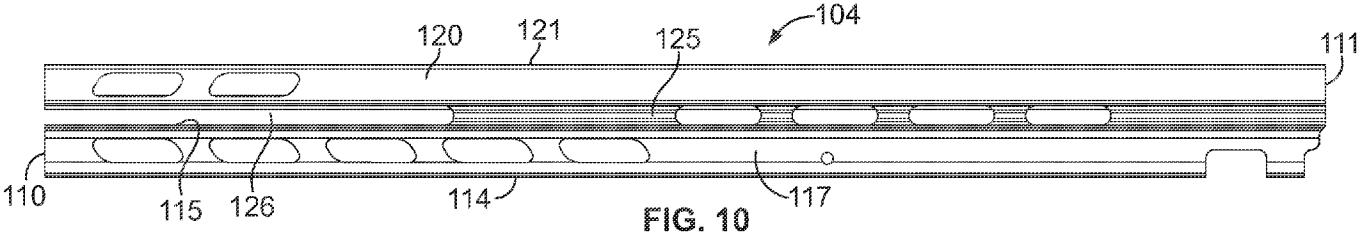
FIG. 10 is a left side view of the barrel of FIG. 8.
Figure 11:
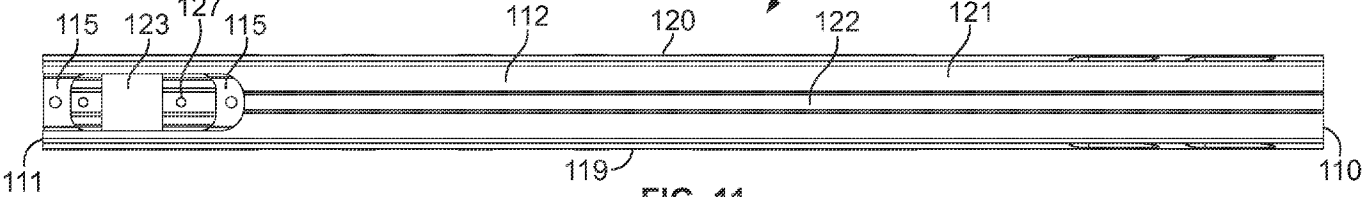
FIG. 11 is a top view of the barrel of FIG. 8.
Figure 12:
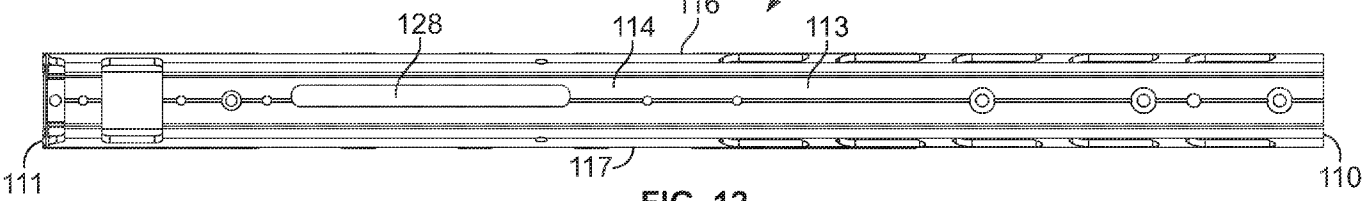
FIG. 12 is a bottom view of the barrel of FIG. 8.

As best illustrated in FIGS. 1, 2 and 4, the crossbow 100 has a frame 102 which is preferably elongated. The frame 102 preferably includes a barrel 104, a riser 106 and a stock 108 which are all secured to one another.

The barrel 104 is best illustrated in FIGS. 8-12. The barrel 104 preferably is an elongated member having a forward end 110, an opposite rearward end 111, an upper portion 112 and a lower portion 113.

The lower portion 113 is generally tubular in configuration and defines a bottom wall 114, an upper wall 115, and right and left side walls 116, 117. The lower portion 113 is preferably hollow between the walls 114, 115, 116, 117, thereby defining an passageway 118 which extends therethrough from the forward end 110 to the rearward end 111. The bottom wall 114 has an opening 128 therethrough and the upper wall 115 has an opening 127 therethrough. The opening 127 of the upper wall 115 is provided rearward of the opening 128 of the bottom wall 114.

The upper portion 112 is generally shaped in the form of an upside down W. The upper portion 112 thus has right and left side walls 119, 120 and a top wall 121. The top wall 121 is formed to define an elongated rail slot 122 on the top surface thereof. The elongated rail slot 122 has a width which is sized to support a bolt positioned therein. A rearward end portion of the top wall 121 is not shaped in the form of an upside down W, but rather provides an opening 123 therethrough which is wider than the elongated rail slot 122. The elongated rail slot 122 extends from the forward end 110 of the barrel 104 toward the opening 123. The opening 123 preferably is in communication with the elongated rail slot 122 and extends to the rearward end 111 of the barrel 104.

A right side connecting wall 124 connects the right side wall 116 of the lower portion 113 to the right side wall 119 of the upper portion 112. Likewise, a left side connecting wall 125 connects the left side wall 117 of the lower portion 113 to the left side wall 120 of the upper portion 112. The positioning of the upper portion 112 relative to the lower portion 113 provides that the opening 123 provided through the top wall 121 of the upper portion 112 is positioned over the opening 127 of the upper wall 115 of the lower portion 113. The right and left side connecting walls 124, 125 extend from the rearward end 111 of the barrel 104, but do not extend all the way to the forward end 110 of the barrel 104. Thus, a cable slot 126 is formed between the upper and lower portions 112, 113. The cable slot 126 extends from the forward end 110 to the right and left side connecting walls 124, 125.

If desired, the barrel 104 may have further openings or slots provided therein or therethrough in order to lessen the weight of the barrel 104 and, thus, the weight of the crossbow 100.

Figure 13:
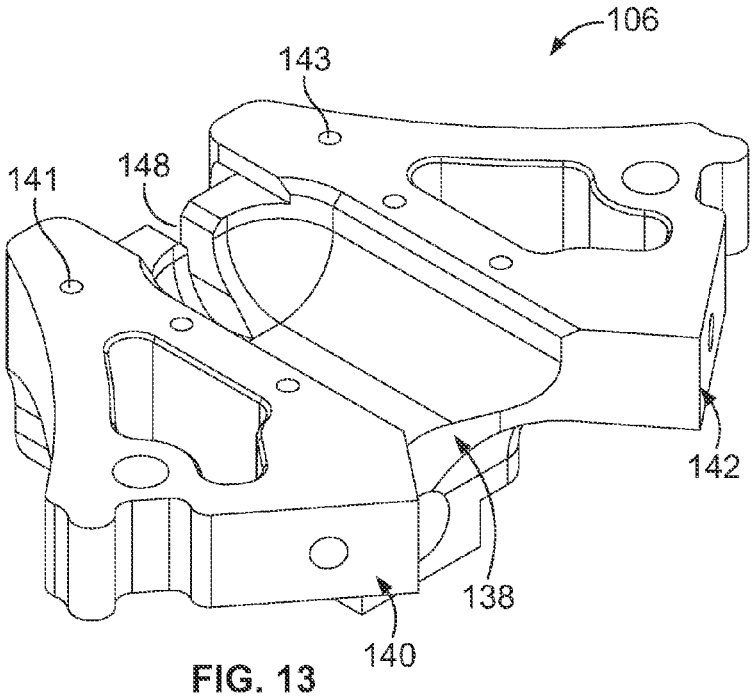
FIG. 13 is a perspective view of a riser of the crossbow of FIG. 1.
Figure 14:
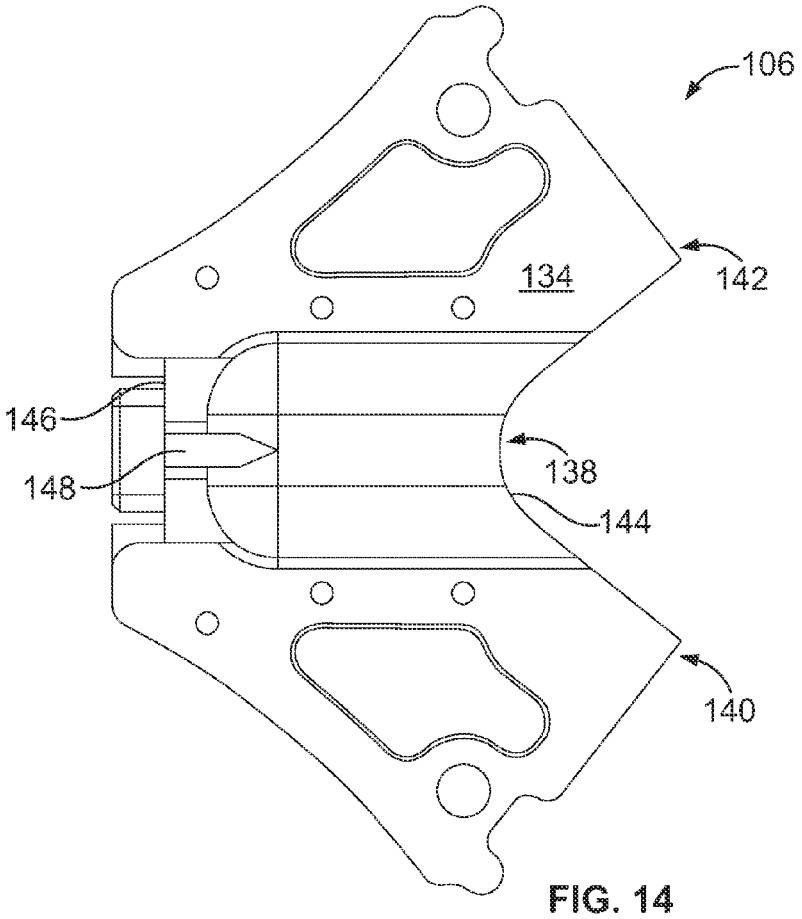
FIG. 14 is a top view of the riser of FIG. 13.
Figure 15:
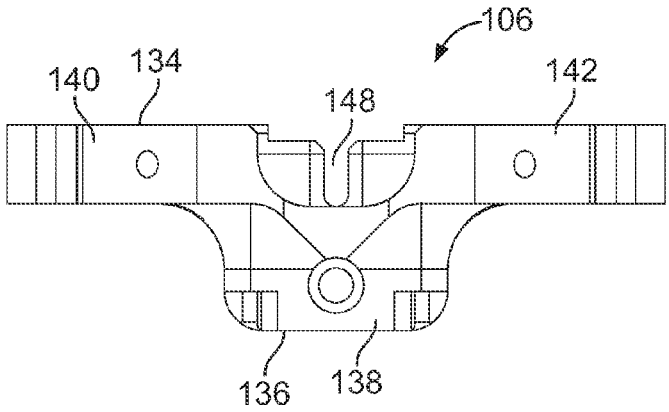
FIG. 15 is a front view of the riser of FIG. 13.
Figure 16:
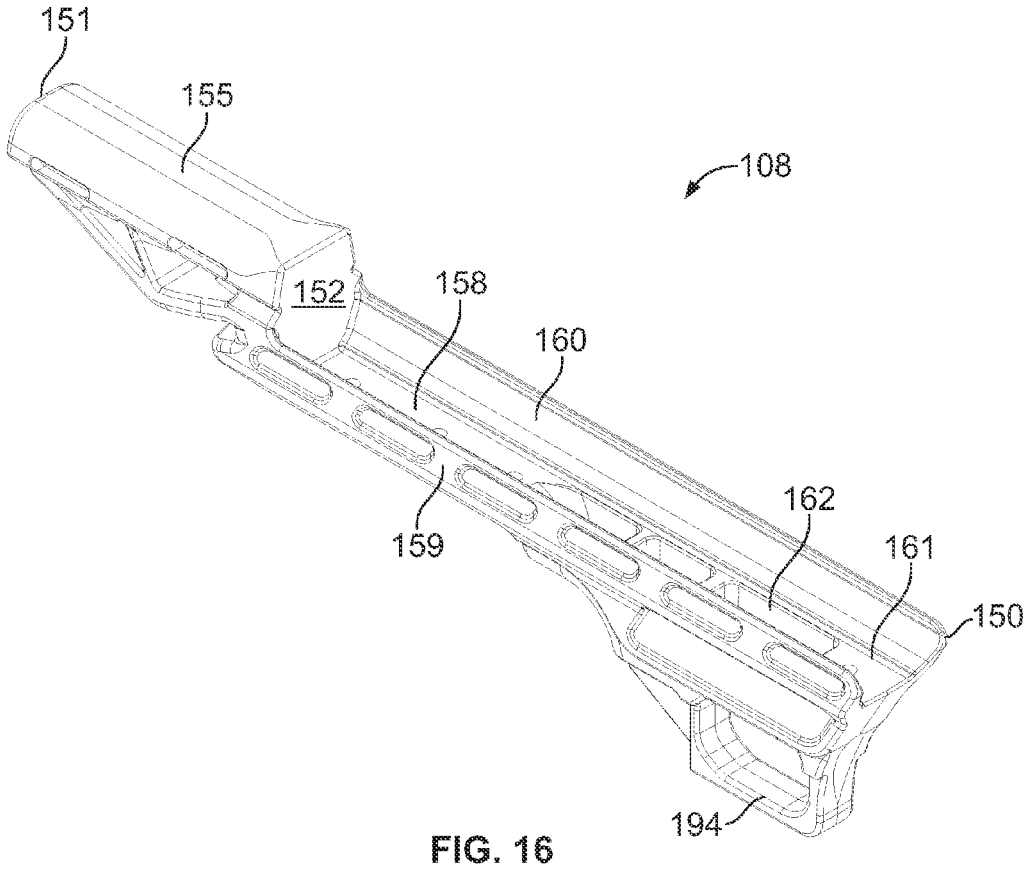
FIG. 16 is a perspective view of a stock of the crossbow of FIG. 1.
Figure 17:
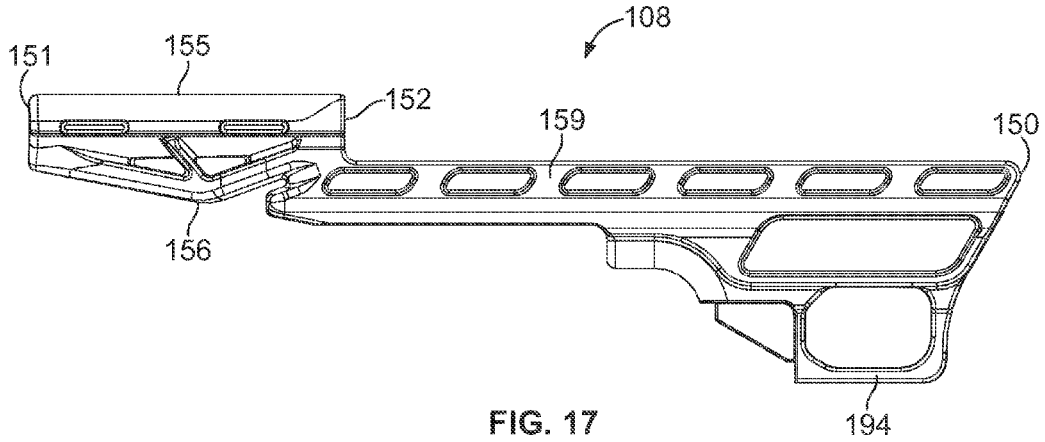
FIG. 17 is a right side view of the stock of FIG. 16.
Figure 18:
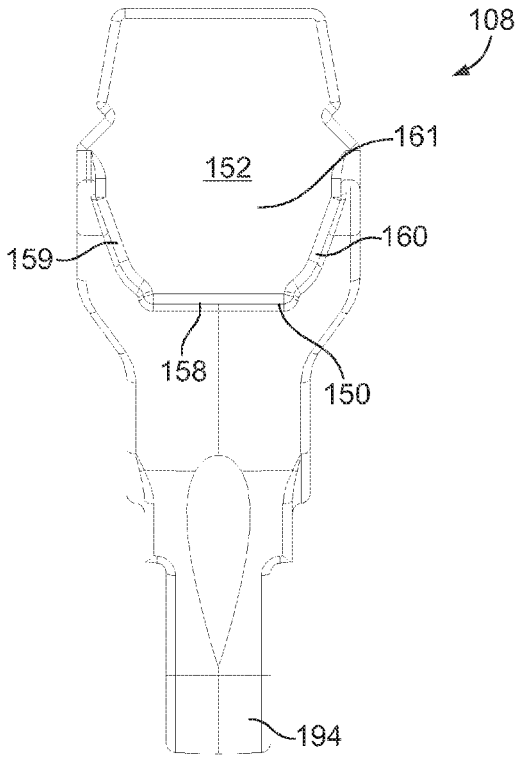
FIG. 18 is a front view of the stock of FIG. 16.
Figure 19:
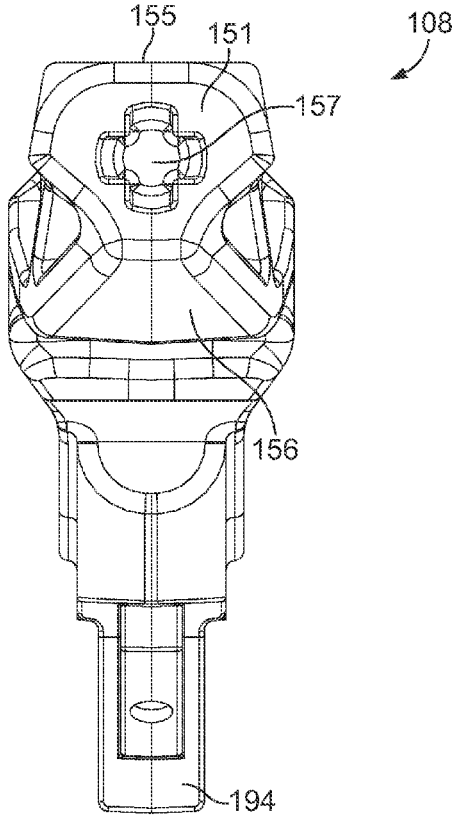
FIG. 19 is a rear view of the stock of FIG. 16.
Figure 20:
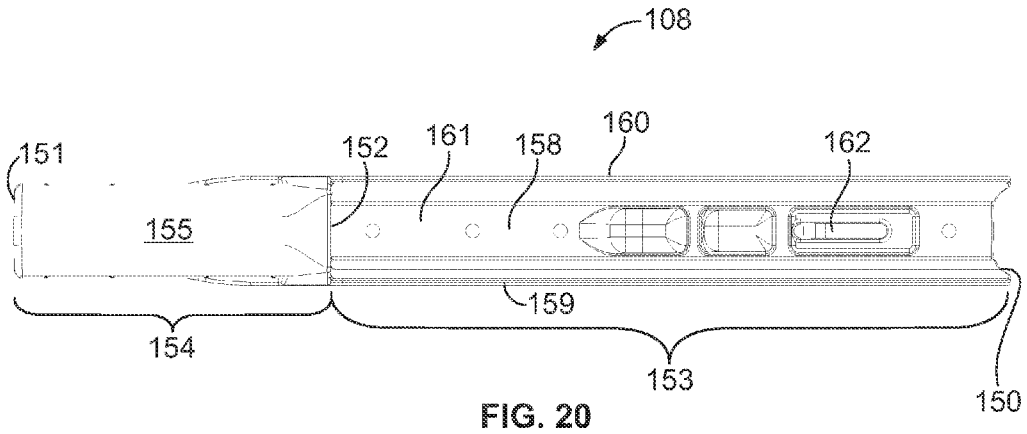
FIG. 20 is a top view of the stock of FIG. 16.

The riser 106 is best illustrated in FIGS. 13-15. The riser 106 preferably has a top surface 134, a bottom surface 136, a central portion 138 and opposing right and left side portions 140, 142, which are preferably integrally formed with the central portion 138. The central portion 138 of the riser 106 has a forward end 144 and a rearward end 146. The riser 106 is secured to the barrel 104 in a known manner, such as by a bolt extending through a lower portion of the central portion 138. The securement of the riser 106 to the barrel 104 preferably provides that the rearward end 146 of the central portion 138 of the riser 106 abuts the forward end 110 of the barrel 104.

The top surface 134 proximate the central portion 138 proximate to the forward end 110 of the barrel 104 preferably is generally planar with a top surface of the top wall 121 of the upper portion 112 of the barrel 104, while the top surface 134 proximate the central portion 138 and distal from the forward end 110 of the barrel 104 is provided below the top wall 121 of the barrel 104. A rail slot 148 is formed in the top surface 134 of the riser 106 which is in alignment with the elongated rail slot 122 formed in the top wall 121 of the barrel 104. The elongated rail slot 122 of the barrel 104 and the rail slot 148 of the riser 106 are commonly collectively referred to as the "rail" of the crossbow 100. Beam mounting holes 141, 143 are provided in the top surface 134 of the riser 106.

The stock 108 is best illustrated in FIGS. 16-20. The stock 108 preferably is an elongated member having a forward end 150 and an opposite rearward end 151. A shoulder 152 is provided between the forward and rearward ends 150, 151 to define forward and rearward end portions 153, 154 of the stock 108 (see, FIG. 20). The forward end portion 153 is defined between the forward end 150 and the shoulder 152, and the rearward end portion 154 is defined between the rearward end 151 and the shoulder 153. The rearward end portion 154 has a top surface 155 and a bottom surface 156. The rearward end portion 154 may have a slot 157 provided therein which is accessible via the rearward end 151 of the stock 108. The slot 157 (See, FIG. 19) may be used to receive a crossbow accessory, such as a cocking winch as taught in United States Patent Publication No. US 2009/0277435 A1.

The forward end portion 153 has a bottom wall 158 and right and left side walls 159, 160, each of which extend from the forward end 150 to the shoulder 152. The right and left side walls 159, 160 each extend upwardly from the bottom wall 158, but do not extend all the way to the top surface 155 of the rearward end portion 154, such that a slot 161 is defined in the forward end portion 153 of the stock 108. The forward end portion 153 further defines an opening 162 through the bottom wall 158.

The stock 108 is secured to the barrel 104 by known means with the lower portion 113 of the barrel 104 being positioned in the slot 161 of the forward end portion 153 of the stock 108. In this position, the rearward end 111 of the barrel 104 abuts the shoulder 152 of the stock 108 and the opening 162 of the stock 108 is in alignment with the passageway 118 of the barrel 104. The forward end 110 of the barrel 104 is preferably positioned forward of the forward end 150 of the stock 108. If desired, the stock 108 may be integrally formed with the barrel 104.

Figure 24:
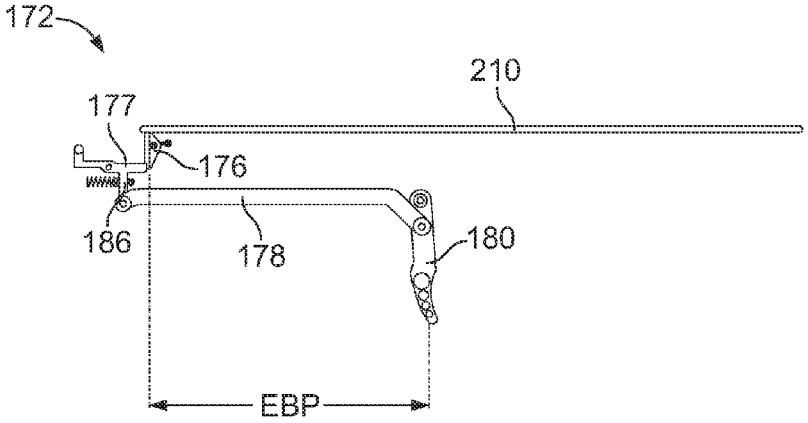
FIG. 24 is a right side view of portions of the firing assembly of the crossbow of FIG. 23, and illustrating the bowstring being engaged with a string latch of the firing assembly to provide that the bowstring is in the rearward cocked position.

As best illustrated in FIGS. 2 and 24, the crossbow 100 includes a firing assembly 172 of a type which is generally known in the art. As best illustrated in FIG. 2, the firing assembly 172 includes a trigger box 174. The trigger box 174 is preferably secured to the barrel 104 and is positioned over the opening 123 of the upper portion 112 of the barrel 104. The trigger box 174 preferably has a top wall 181, a rearward wall 182, and right and left side walls 183, 184, which define a cavity 185 of the trigger box 174. The trigger box 174 may be integrally formed with the barrel 104 and/or the stock 108. The cavity 185 of the trigger box 174 is open to the opening 123 of the upper portion 112 and to the opening 127 of the upper wall 115 of the lower portion 113 of the barrel 104 and, therefore, is in communication with the passageway 118 which extends through the lower portion 113 of the barrel 104.

As best illustrated in FIG. 24, the firing assembly 172 also includes a string latch 176, a biasing member 177, an elongated linkage 178 and a finger-pull mechanism 180. The string latch 176 is preferably positioned partially within the cavity 185 of the trigger box 174 and extends into the opening 123 of the upper portion 112 of the barrel 104. The biasing member 177 is also positioned within the opening 123 and includes a leg 186 which extends through the opening 127 in the upper wall 115 of the lower portion 113 of the barrel 104, into the passageway 118 of the lower portion 113 of the barrel 104. The elongated linkage 178 is positioned within the passageway 118 of the lower portion 113 of the barrel 104. The string latch 176 is operatively associated with the biasing member 177 in order to bias the string latch 176 in a bowstring retaining position. As shown in FIG. 24, the leg 186 of the biasing member 177 is operatively associated with a rearward portion of the elongated linkage 178. A forward portion of the elongated linkage 178 is secured to the finger-pull mechanism 180. The finger pull-mechanism 180 extends downwardly through the opening 128 in the bottom wall 114 of the lower portion 113 of the barrel 104 and downwardly through the opening 162 in the forward end portion 153 of the stock 108. If desired, the stock 108 may be formed with a guard portion 194 which extends downwardly and around the finger-pull mechanism 180.

Due to the use of this type of firing assembly 172 in the crossbow 100, where the action, e.g., the string latch 176, is located rearward of the finger-pull mechanism 180, the crossbow 100 is commonly called a crossbow having a "bullpup" stock. For purposes herein, a bullpup distance will be defined as a distance from a portion of the string latch 176 that engages the bowstring to the finger-pull mechanism 180.

The crossbow 100 includes a grip 196 which preferably extends downwardly from the bottom wall 158 of the forward end portion 153 of the stock 108, rearward of the finger-pull mechanism 180. The grip 196 may be integrally formed with the bottom wall 158 of the forward end portion 153 of the stock 108, or may preferably be a separate piece which is secured to the forward end portion 153 of the stock 108 and/or to the guard portion 194 of the stock 108, if provided, in a known manner.

The crossbow 100 includes first and second limbs 198, 200, which are preferably flexible in configuration. As best illustrated in FIG. 1, each of the limbs 198, 200 are preferably formed as "split limbs." The first limb 198 extends from, and is secured to, the right side portion 140 of the riser 106 and the second limb 200 extends from, and is secured to, the left side portion 142 of the riser 106. The first limb 198 has a limb tip 202 and the second limb 200 has a limb tip 204 (See, FIG. 5).

The crossbow 100 includes first and second rotatable wheels or pulleys 206, 208 which are mounted at the limb tips 202, 204, respectively. The pulleys 206, 208 are preferably non-circular cams, but may also be formed as circular pulleys.

The crossbow 100 includes a bowstring 210. The bowstring 210 extends between the pulleys 206, 208 and is connected at a first end thereof to the pulley 206 and at an opposite, second end thereof to the pulley 208. In a forward rest position, as illustrated in FIGS. 1-7, the bowstring 210 is configured to extend generally perpendicular to the elongated barrel 104 and is further positioned above the top wall 121 of the upper portion 112 of the barrel 104.

The crossbow 100 includes a pair of cables 212, 214. The cables 212, 214 are commonly referred to as power cables or tension cables. A first end of the cable 212 is connected to the pulley 206 and a second, opposite end of the cable 212 is connected to the limb tip 204 of the second limb 200. A first end of the cable 214 is connected to the pulley 208 and a second, opposite end of the cable 214 is connected to the limb tip 202 of the first limb 198. The cables 212, 214 are configured to extend generally transverse to the elongated barrel 104 and are further positioned to extend through the cable slot 126 of the barrel 104.

Figure 3:
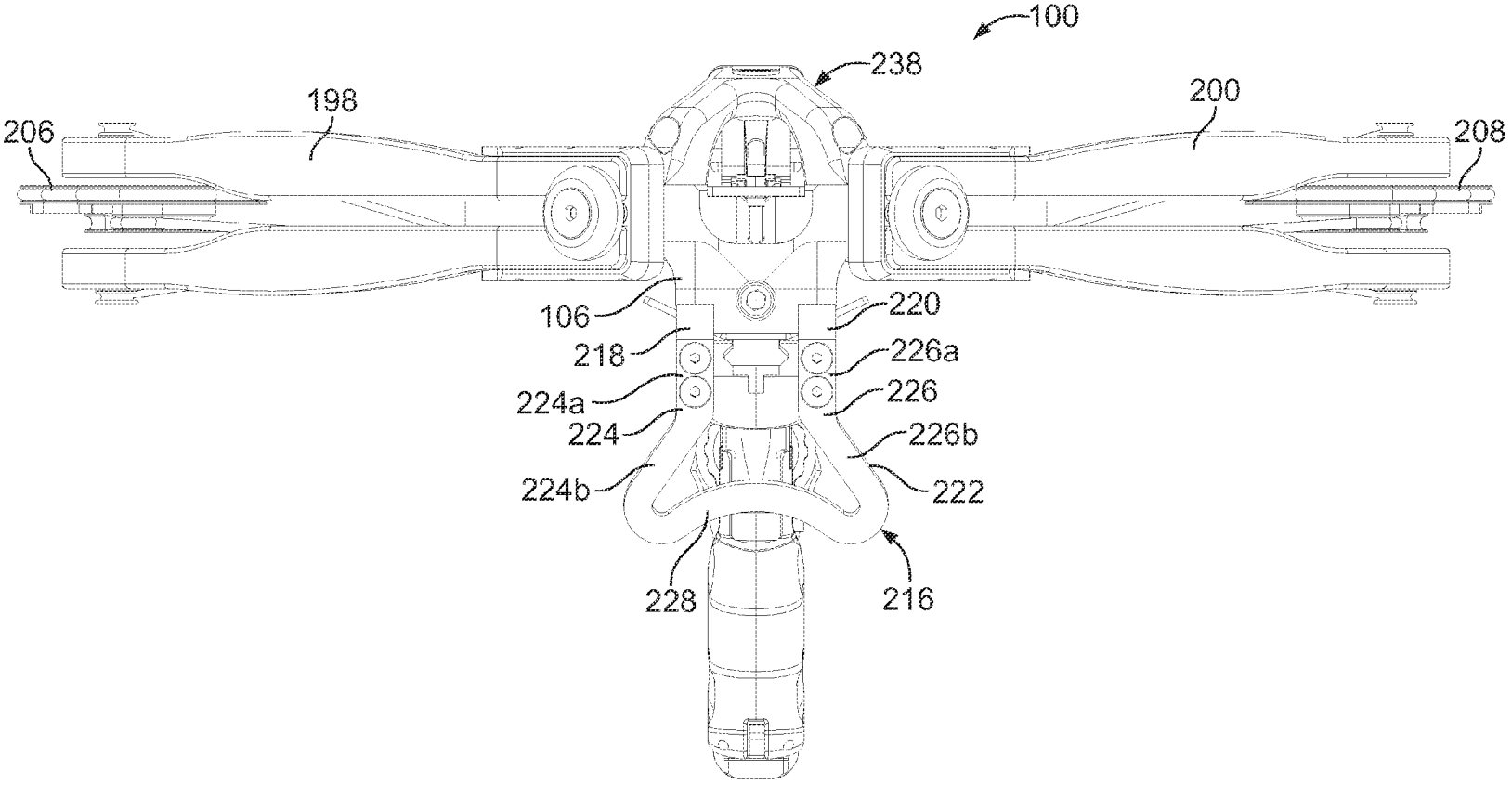
FIG. 3 is a front view of the crossbow of FIG. 1.

The crossbow 100 includes a foot stirrup 216, as best shown in FIG. 3. The foot stirrup 216 includes first and second extending legs 218, 220 and a generally U-shaped leg 222. The first and second legs 218, 220 each are preferably connected to the central portion 138 of the riser 106, and are preferably spaced from one another. The generally U-shaped leg 222 has first and second leg portions 224, 226 and a base portion 228 connecting the first leg portion 224 to the second leg portion 226. The first leg portion 224 of the U-shaped leg 222 is also connected to the first leg 218 and extends downwardly therefrom to the base portion 228. The second leg portion 226 of the U-shaped leg 222 is also connected to the second leg 220 and extends downwardly therefrom to the base portion 228. In the preferred embodiment, the first and second leg portions 224, 226 have upper portions **224*a*, 226*a* which extend straight downwardly from the first and second legs 218, 220 and lower portions 224*b*, 226*b* which extend downwardly and outwardly from the upper portions 224*a*, 226*a*, in opposite directions, to the base portion 228, such that the base portion 228 has a width which is greater than a distance between the first and second legs 218, 220. The first and second leg portions 224, 226 of the U-shaped leg 222 thus are generally perpendicular to the base portion 228 of the U-shaped leg 222 and to the first and second extending legs 218, 220. The base portion 228 of the U-shaped leg 222 is also generally perpendicular to the first and second extending legs 218, 220, but has an upwardly extending bump. The first and second legs 218, 220 and the U-shaped leg 222 may be integrally formed or may be formed of separate pieces which are secured to one another. Furthermore, the foot stirrup 216 may be integrally formed with the riser 106**.

As best shown in FIG. 2, the crossbow 100 includes a mounting rail 230 which is secured to a bottom surface of the bottom wall 114 of the lower portion 113 of the barrel 104, forward of the forward end 150 of the stock 108. The mounting rail 230 is configured to enable typical crossbow accessories to be mounted thereto. The mounting rail 230 is preferably a Picatinny rail, as shown, or a Weaver rail, both of which are well-known in the art. The mounting rail 230 may be integrally formed with the bottom wall 114 of the barrel 104.

One accessory which is preferably provided on, and secured to, the mounting rail 230 of the crossbow 100 is a forearm 232. As the forearm 232 is preferably secured to the mounting rail 230, the position of the forearm 232 along the mounting rail 230 can be adjusted as desired. The forearm 232 has a bottom surface 234 which is configured to be positioned against, and provide comfort to, a user's forearm or hand when the crossbow 100 is aimed and fired.

Another accessory which may be provided on, and secured to, the mounting rail 230 of the crossbow 100 is a foregrip (not shown). As the foregrip is preferably secured to the mounting rail 230, the position of the foregrip along the mounting rail 230 can be adjusted as desired. If the crossbow 100 is outfitted with both the forearm 232 and the foregrip, the foregrip is preferably positioned forward of the forearm 232. The foregrip is also preferably movable between different angular positions relative to the barrel 104. For instance, the foregrip could be provided in a general parallel manner to the barrel 104, which could be so positioned, for instance, when transporting the crossbow 100. The foregrip could also be provided in a general perpendicular manner to the barrel 104, which could be so positioned, for instance, when aiming and firing the crossbow 100. The foregrip could also be provided in a generally acute or obtuse angle relative to the barrel 104, if desired.

Figure 21:
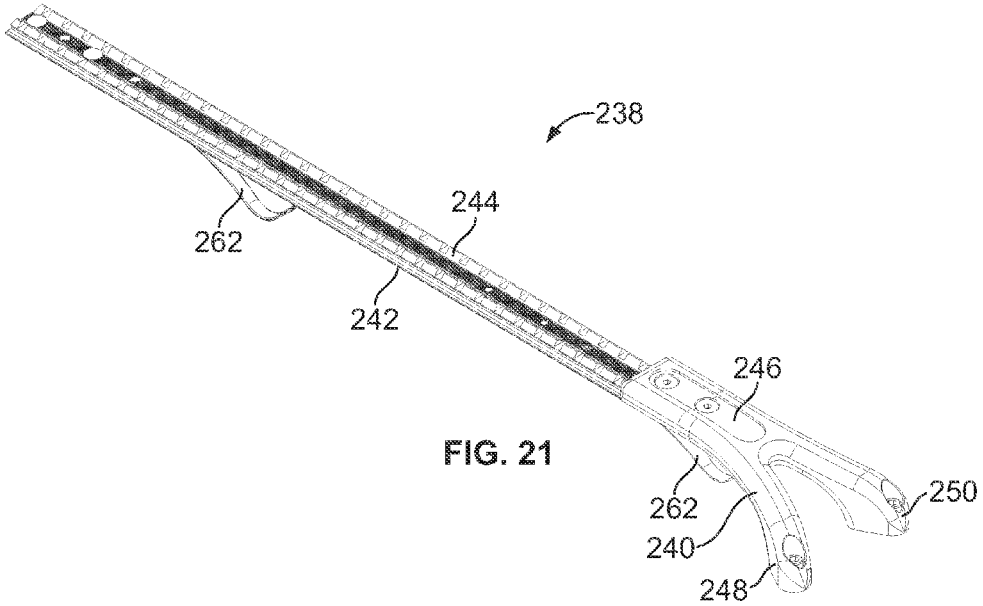
FIG. 21 is a perspective view of a beam of the crossbow of FIG. 1, having a pair of retention springs extending downwardly therefrom.
Figure 22:
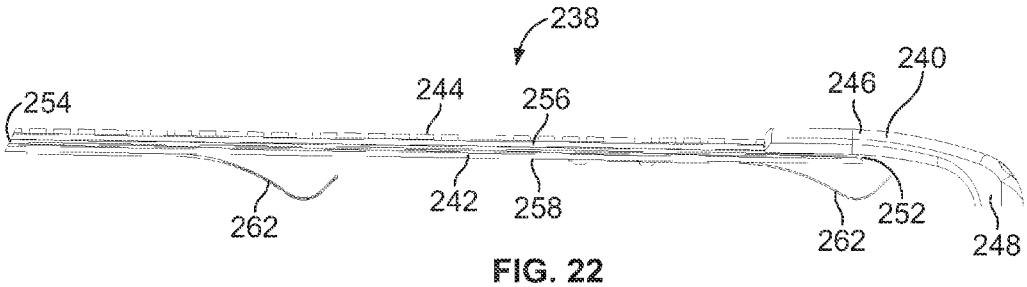
FIG. 22 is a right side view of the beam of FIG. 21.

The crossbow 100 includes a beam 238. As best illustrated in FIGS. 21 and 22, the beam 238 includes a base 240, an extension 242 and a mounting rail 244. The base 240 is preferably formed in the shape of a "Y" as it has a body 246 and first and second legs 248, 250 extending therefrom at opposite angles. The body 246 and the first and second legs 248, 250 are preferably integrally formed. The first and second legs 248, 250 also are preferably formed to extend downwardly and forwardly from the body 246, preferably in an arched manner. The first leg 248 of the base 240 is preferably secured to the right side portion 140 of the riser 106, preferably proximate to the forward end 110 of the barrel 104 at the beam mounting hole 141. The second leg 250 of the base 240 is preferably secured to the left side portion 142 of the riser 106, preferably proximate to the forward end 110 of the barrel 104 at the beam mounting hole 143. With the first and second legs 248, 250 secured to the riser 106 in this manner, the body 246 of the base 240 is preferably positioned to extend directly over the top wall 121 of the upper portion 112 of the barrel 104, as well as over the forward rest position of the bowstring 210. The base 240 may be integrally formed with the riser 106.

The extension 242 of the beam 238 has forward and rearward ends 252, 254 and top and bottom surfaces 256, 258. The top surface 256 of the extension 242 proximate to the forward end 252 thereof is secured to a bottom surface of the body 246 of the base 240 of the beam 238. The bottom surface 258 of the extension 242 proximate to the rearward end 254 thereof is secured to the top wall 182 of the trigger box 174 of the firing assembly 172. The extension 242 of the beam 238 is thus preferably positioned to extend directly over the top wall 121 of the upper portion 112 of the barrel 104. The extension 242 may be integrally formed with the trigger box 174 and/or the base 240.

The mounting rail 244 of the beam 238 is secured to the top surface 256 of the extension 242, rearward of the base 240 of the beam 238. The mounting rail 244 is configured to enable typical crossbow accessories to be mounted thereto. The mounting rail 244 is preferably a Picatinny rail, as shown, or a Weaver rail, both of which are well-known in the art. The mounting rail 244 may be integrally formed with the extension 242 and/or the base 240. The mounting rail 244 may also extend onto the base 240.

The crossbow 100 includes a retention spring 262 for biasing a cocked bolt in position prior to firing. As known in the prior art, the retention spring 262 is provided proximate to the string latch 176 of the firing assembly 172, but may alternatively be provided distal from the string latch 176 of the firing assembly 172. When the retention spring 262 is provided proximate to the string latch 176 of the firing assembly 172, a first end of the retention spring 262 is mounted from either the top wall 181 of the trigger box 174 of the firing assembly 172 or, more preferably, from the extension 242 of the beam 238, and more particularly from the bottom surface 258 of the extension 242. A second end of the retention spring 262 extends downwardly and forwardly from the first end and is adapted to bias, and thus retain, a bolt to the rail. When the retention spring 262 is provided distal from the string latch 176 of the firing assembly 172, the first end of the retention spring 262 is preferably mounted from the extension 242 of the beam 238, proximate to the connection of the extension 242 to the base 240 of the beam 238, and the second end of the retention spring 262 is preferably positioned forward of the forward rest position of the bowstring 210. More particularly, the first end of the retention spring 262 is preferably mounted from the bottom surface 258 of the extension 242 proximate to the connection of the extension 242 to the base 240 of the beam 238. If desired, and as best illustrated in FIGS. 2 and 22, the crossbow 100 may preferably have two retention springs 262, one of which biases the bolt to the rail proximate to the string latch 176 of the firing assembly 172 and one of which biases the bolt to the rail distal to the string latch 176 of the firing assembly 172 and forward of the forward rest position of the bowstring 210.

As shown in FIG. 2, the crossbow 100 includes a mounting rail 264 which is secured to a bottom surface of the bottom wall 158 of the forward end portion 153 of the stock 108, but rearward of the finger-pull mechanism 180 and the grip 196. The mounting rail 264 is configured to enable typical crossbow accessories to be mounted thereto. The mounting rail 264 is preferably a Picatinny rail, as shown, or a Weaver rail, both of which are well-known in the art. The mounting rail 264 may be integrally formed with the bottom wall.

Figure 26:
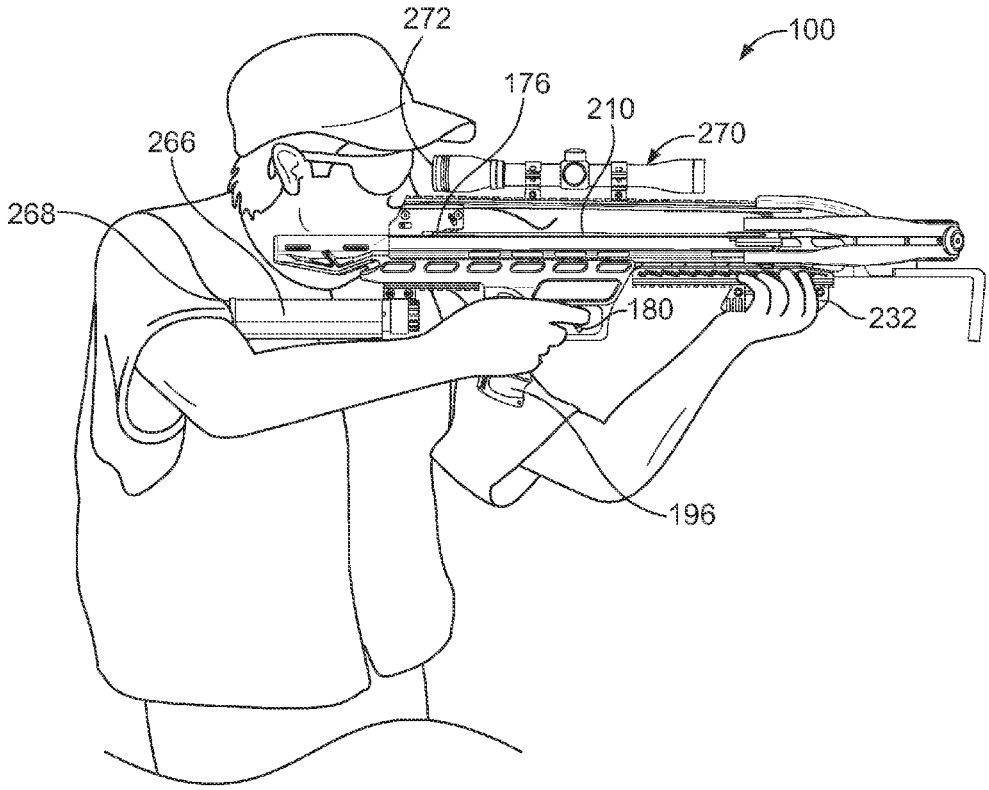
FIG. 26 is a right side view of the crossbow of FIG. 25, with a forearm in a forward position, being aimed by a user.

One accessory which is preferably provided on, and secured to, the mounting rail 264 of the crossbow 100 is a butt member 266. As the butt member 266 is preferably secured to the mounting rail 264, the position of the butt member 266 along the mounting rail 264 can be adjusted as desired. The butt member 266 has a rearward or butt end 268. The butt end 268 of the butt member 266 is also defined as the rearward end of the crossbow 100 (although it is to be understood that if the butt member 266 is positioned to be proximate to the finger-pull mechanism 180 and the grip 196 that, depending on the configuration of the butt member 266 and the rearward end portion 154 of the stock 108, that the rearward end 151 of the stock 108 may be positioned slightly rearward of the butt end 268 of the butt member 266 such that the rearward end 151 of the stock 108 may alternatively be defined as the rearward end of the crossbow 100). The butt end 268 of the butt member 266 is configured to abut against a front of a user, typically a torso of the user proximate to or at the user's shoulder, when the crossbow 100 is aimed and fired. If desired, the butt end 268 of the butt member 266 may be provided with padding or cushioning (not shown). If desired, the butt member 266 may also be telescopic such that a length of the butt member 266 can be changed as desired, where the length of the butt member 266 is generally defined by a distance from the butt end 268 to the connection between the butt member 266 and the mounting rail 264. A length of pull of the crossbow 100 is generally defined as a distance (LP) from the finger-pull mechanism 180 to a position where the crossbow 100 abuts against a body of a user which, in the case of crossbow 100, is the rear end 268 of the butt member 266, as illustrated in FIGS. 2 and 26. If desired, the length of pull distance (LP) can be increased or decreased, as desired, due to the adjustability of the butt member 266. The length of pull distance (LP) can further be increased, if desired, by adding padding or cushioning on the butt end 268 of the butt member 266, thereby moving slightly rearward the actual physical rear end 268 of the butt member 266.

Figure 23:
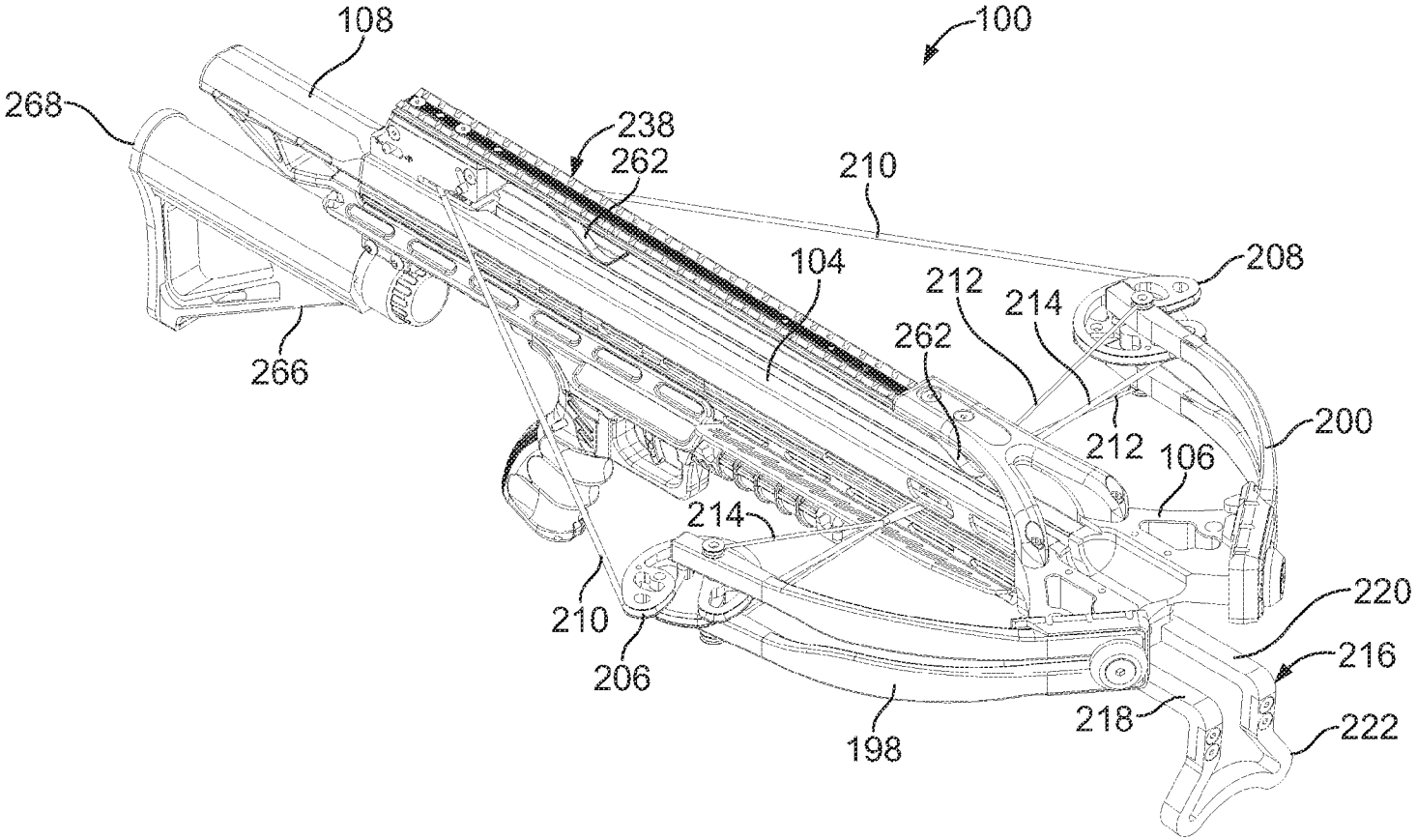
FIG. 23 is a perspective view of the crossbow of FIG. 1, but with the bowstring in a rearward cocked position.

In order to use the crossbow 100, a user must first move the bowstring 210 from its forward rest or fired position, as illustrated in FIGS. 1-7, to its rearward cocked position, as illustrated in FIGS. 23 and 24. This is typically performed by positioning the crossbow 100 such that the base and first and second leg portions 228, 224, 226 of the foot stirrup 216 are positioned generally flat against a hard surface, such as the ground. The user will then position one of his/her feet on top of one or all, preferably all, of the base and first and second leg portions 228, 224, 226 of the foot stirrup 216 in order to stabilize the crossbow 100 prior to the cocking of the bowstring 210. The user's foot will typically be positioned to either have the toe portion of the user's shoe or boot slightly extend into the gap provided between the first and second extending legs 218, 220, such that the rearward portions of the user's shoe or boot will be positioned on the base and first and second leg portions 228, 224, 226 of the foot stirrup 216. Alternatively, the user's foot can be angled in a manner whereby the toe portion of the user's shoe or boot will not extend into the gap between the first and second extending legs 218, 220, but will still allow for portions of the user's shoe or boot to be positioned on the base and first and second leg portions 228, 224, 226 of the foot stirrup 216.

When the crossbow 100 is stabilized in position, the user then utilizes a rope cocker of types well-known in the art, to pull the bowstring 210 rearward from its rest position to its cocked position, where the bowstring is engaged with the string latch 176 of the firing assembly 172, as best illustrated in FIG. 24. As the bowstring 210 is moved rearwardly above the top wall 121 of the upper portion 112 of the barrel 104, the bowstring 210 engages a forward surface of the string latch 176. Further rearward movement of the bowstring 210 overcomes the force exerted on the string latch 176 by the biasing member 177, thereby allowing the string latch 176 and biasing member 177 to pivot and the bowstring 210 to rearward of the string latch 176. Once the bowstring 210 moves past the string latch 176, the biasing member 177 causes the string latch 176 to return to its bowstring retaining position and the bowstring 210 is held in place against a rearward surface of the string latch 176. Moving the bowstring 210 to its cocked position causes the limbs 198, 200 to flex inwardly toward the barrel 104. The provision of the cables 212, 214 reduces the energy held in the limbs 198, 200 after the bowstring 210 is cocked, but prior to the firing of the crossbow 100. It should be noted that if a cocking winch (not shown) is used to move the bowstring 210 from its forward rest position to its rearward cocked position, that the foot stirrup 216 does not need to be provided on the crossbow 100.

Once the bowstring 210 is provided in its cocked position, a bolt (not shown), is positioned in the rail of the crossbow 100. While positioning the bolt in the rail, the bolt is moved underneath the retention spring(s) 262 which bias the bolt in the rail. A nock of the bolt is engaged with the bowstring 210 proximate to, or at, the string latch 176 of the firing assembly 172. The bolt has fletching provided proximate to the nock and one of the vanes of the fletching is to be positioned within the rail of the crossbow 100 and, therefore, the rail of the crossbow 100 is preferably deep enough to avoid causing damage to the vane positioned therein when the bolt is fired from the crossbow 100. The bolt further typically has a tip or broadhead at an end opposite the nock. The broadhead is typically larger and wider than the rail of the crossbow 100 and, therefore, is preferably positioned over the top surface 134 of the central portion 138 of the riser 106, proximate to the forward end 144 thereof. The bolt extends between the first and second legs 248, 250 of the base 240 of the beam 238. The retention spring(s) 262 loosely hold the bolt in position in the rail of the crossbow 100 in order to prevent the bolt from moving out of the rail as the crossbow 100 is moved around.

With the bowstring 210 provided in its cocked position and the bolt being engaged with the bowstring 210 and positioned within the rail of the crossbow 100, a user can ready him or herself for firing the crossbow 100, as illustrated in FIG. 26. It is noted that the bolt is not illustrated in FIG. 26. The user will thus position the butt end 268 of the butt member 266 against his/her torso, proximate to or against his/her right shoulder (description is provided for a right-handed user, with the understanding that the positioning would typically be reversed for a left-handed user). Positioning the butt end 268 of the butt member 266 in this manner allows the user to steady a rear portion of the crossbow 100, support a rearward weight of the crossbow 100, and also allows for the minimization of any recoil or kick of the crossbow 100 (recoil or kick of a crossbow 100 is typically minimal and non-noticeable) upon firing. The rearward weight of the crossbow 100 is defined herein as a weight of the crossbow 100 rearward of the grip 196. Likewise, a forward weight of the crossbow 100 is defined herein as a weight of the crossbow 100 forward of the grip 196.

The user's right hand would then hold the grip 196 such that one of the user's fingers on his/her right hand, typically, the index finger, is positioned around the finger-pull mechanism 180. As the grip 196 is where the crossbow 100 is held, the position of the grip 196 generally acts as a fulcrum point of the crossbow 100 with the forward weight of the crossbow 100 being forward of the grip 196 and with the rearward weight of the crossbow 100 being rearward of the grip 196. Positioning the user's right hand in this manner allows the user to support the weight of the crossbow 100 and to pull the finger-pull mechanism 180, which causes the elongated linkage 176 to move the biasing member 177. Movement of the biasing member 177 allows the string latch 176 to pivot, thereby allowing for the release the bowstring 210 so that it is propelled forward from its cocked position to its rest position, which in turn causes the bolt to be fired from the crossbow 100. The user would then also be able to use either his/her left arm or left hand, as desired, to aid in the support of the forward weight of the crossbow 100 by engaging the forearm 232 or the foregrip.

The crossbow 100 provides a number of advantages over crossbows of the prior art. More specifically, the crossbow 100 includes at least the following advantages over crossbows of the prior art.

One advantage of the crossbow 100 in comparison to crossbows of the prior art is that the beam 238/mounting rail 244 provides the crossbow 100 with additional area for mounting accessories to the crossbow 100. As prior art crossbows only allow for mounting of a sighting device, such as a scope or sight, in a location generally above the trigger box 174 of the firing assembly (which is always provided in a rearward portion of the crossbow), the beam 238/mounting rail 244 provide the crossbow 100 with additional area, namely area above the entire barrel 104, including the area forward of the forward rest position of the bowstring 210, as well as the area rearward of the forward rest portion of the bowstring 210 but distal from the trigger box 174 of the firing assembly 172, to mount accessories compared to prior art crossbows. The beam 238/mounting rail 244 can accommodate numerous accessories being mounted thereto including, but not limited to, a sighting device, a camera (e.g., video, digital, high-speed, etc.) and a quiver mount used to hold extra bolts. It is understood that if the sighting device is mounted on the beam 238/mounting rail 244, that accessories mounted forward of the sighting device should not block a line of sight of the sighting device, otherwise the mounting of the sighting device would be rendered moot. Thus, any accessories mounted forward of the sighting device may, depending on their size and configuration, need to be offset from the beam 238/mounting rail 244. Furthermore, due to the length of the beam 238, the positioning, and thus the weight, of the accessories can be planned so that the overall weight distribution of the crossbow 100 remains balanced from side-to-side and/or from front-to-back.

Another advantage of the crossbow 100 in comparison to the crossbows of the prior art is the provision of the retention spring 262 being provided distal from the spring latch 176. The retention spring 262 preferably engages a bolt forward of the forward rest position of the bowstring 210. Thus, the retention spring 262 provides both for containment of the bolt forward of the forward rest position of the bowstring 210, as well as to hold the bolt in place under tension forward of the forward rest position of the bowstring 210, thereby ensuring the stability of a forward portion of the bolt in the rail of the crossbow 100. Using two retention springs 262, one forward and one rearward, provides further stabilization of the bolt in the rail. The forward retention spring 262 also controls the bolt upon insertion into the crossbow 100. The forward retention spring 262 further prevents forward movement of the bolt and possible dryfire of the crossbow 100 resulting therefrom in the instance where a forward end of the crossbow 100 is moved to a downward position relative to the rearward end of the crossbow 100.

Yet another advantage of the crossbow 100 in comparison to the crossbows of the prior art is the ability to increase the power stroke of the crossbow 100, and therefore the strength of the crossbow 100, in a manner which does not unduly add to the forward weight of the crossbow 100, all without affecting the length of pull distance (LP) of the crossbow 100. Unlike prior art crossbows which have a maximum bullpup distance of six (6) inches, the crossbow 100 is configured to have a bullpup distance greater than six (6) inches (hereinafter referred to as an extreme bullpup distance and illustrated in FIG. 24 as reference EBP). In a preferred embodiment, the extreme bullpup distance (EBP) of the crossbow 100 is greater than six (6) inches and equal to or less than eight (8) inches. The additional distance provided by the extreme bullpup distance (EBP) results from adding length to the barrel 104 at the rearward end thereof and then moving the string latch 176 rearward. The additional distance provided by the extreme bullpup distance (EBP) also provides a number of advantages to the crossbow 100. More specifically, the power stroke of the crossbow 100 is increased which is desired. Notably, this increase in power stroke is achieved without lengthening the overall dimensions of the crossbow 100. The additional distance provided by the extreme bullpup distance (EBP) also adds weight only to the rearward weight of the crossbow 100 as opposed to the forward weight of the crossbow 100. Further, as the weight of a typical firing assembly is approximately one (1) pound and the weight of a typical crossbow assembly is approximately eight and one-half (8.5) pounds, the firing assembly typically accounts for approximately twelve percent (12%) of the overall weight of a typical crossbow. Thus, this weight is moved further rearward of the grip 196 of the crossbow 100, compared to prior art crossbows, such that the center of gravity of the crossbow 100 is moved further rearward as well.

Figure 25:
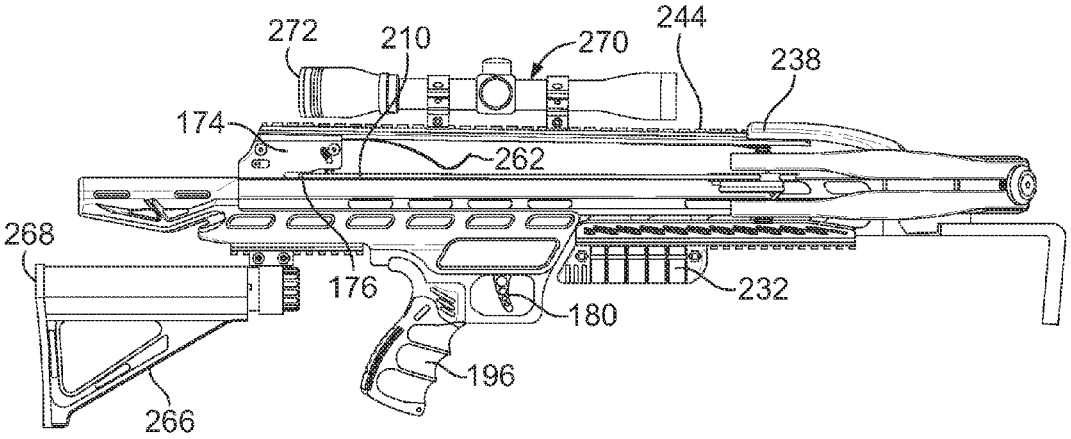
FIG. 25 is a right side view of the crossbow of FIG. 1 with the crossbow having a sighting device mounted on a beam of the crossbow, where an eyepiece of the crossbow is positioned in alignment with the string latch of the firing assembly of the crossbow.
Figure 27:
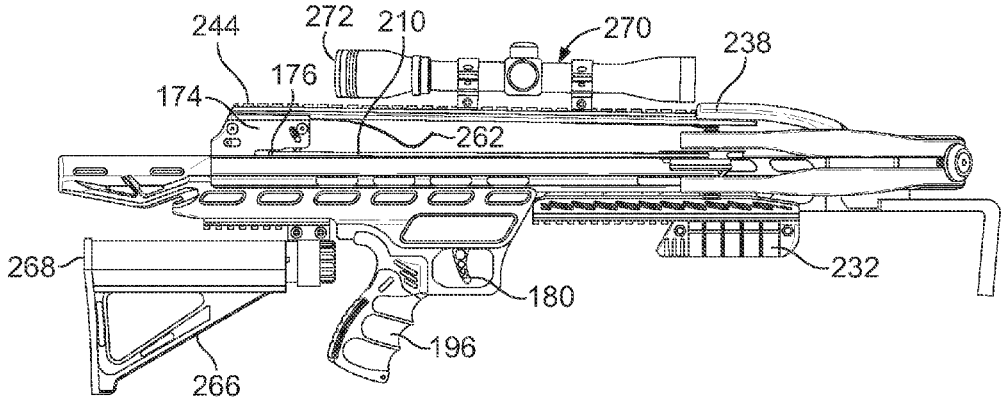
FIG. 27 is a right side view of the crossbow of FIG. 1 with the crossbow having a sighting device mounted on a beam of the crossbow, where an eyepiece of the crossbow is positioned forward of the string latch of the firing assembly of the crossbow, and where a butt member of the crossbow is positioned more proximate to a finger-pull mechanism of the firing assembly of the crossbow.

As explained hereinabove in the "Background of the Invention" section, prior to the crossbow 100, crossbows were not outfitted with bullpup stocks having a bullpup distance of greater than six (6) inches because there would not be sufficient space provided between the butt end of the crossbow and the eyepiece of the sighting device. The sight bridges on which the sighting devices were positioned all only extended slightly forward of the trigger box of the firing assembly, thereby requiring that the eyepieces of the sighting devices on prior art crossbows were all positioned rearward of the string latch. However, due to the provision of the beam 238/mounting rail 244 of the crossbow 100, this deficiency of prior art crossbows can now be overcome by mounting a sighting device 270 on the beam 238/mounting rail 244. The sighting device 270 can be positioned at any position along the length of the beam 238/mounting rail 244 as desired depending on the user's own physical size in combination with the user's own personal preferences for the placement of the eyepiece 272 of the sighting device 270. Thus, the eyepiece 272 of the sighting device 270 may be positioned rearward of the string latch 176 (as is done in prior art crossbows), or in a position in alignment with the string latch 176, as illustrated in FIGS. 25 and 26, or in a position forward of the string latch 176, as illustrated in FIG. 27

It is understood that the mounting of the beam 238 to the riser 106 and the forward movement of the sighting device 270 will add to the forward weight of the crossbow 100, but the further rearward movement of the parts of the firing assembly 172 along with the additional weight of the barrel 104 provided rearward of the grip 196 will, in essence, offset or make up for this added forward weight of the crossbow 100.

Another advantage of the crossbow 100 in comparison to the crossbows of the prior art is the provision of the adjustable butt member 266. The adjustable butt member 266 provides that the crossbow 100 has a length of pull distance (LP) in the range of thirteen (13) inches (where the adjustable butt member 266 is moved as close as possible to the finger-pull mechanism 180—see FIG. 27) to fifteen and one-half (15.5) inches (where the adjustable butt member 266 is moved as far away from the finger-pull mechanism 180 as possible—see FIG. 2). Furthermore, by having the adjustable butt member 266 be a telescoping butt member, and because telescoping butt members add another three (3) to four (4) inches to the length of pull distance (LP), the crossbow 100 provides a range of length of pull distance (LP) of thirteen (13) inches to nineteen and one-half (19.5) inches. Such a range allows for great flexibility than any prior art crossbows with regard to how many users can use the crossbow 100, as the crossbow 100 can essentially be custom-fit to be used by individuals of all shapes and sizes. The butt member 266 thus provides the crossbow 100 with the greatest range of length of pull distance (LP) of any prior art crossbow. Furthermore, the more the length of pull distance (LP) is decreased, the more the center of gravity of the crossbow 100 will be moved rearward.

As the minimal length of pull distance (LP) of prior art crossbows was thirteen (13) inches and as the maximum bullpup distance of prior art crossbows was six (6) inches, no prior art crossbow had a ratio of length of pull distance (LP) to bullpup distance of two-to-one (2:1) or less. Because the crossbow 100 of the present invention can have lengths of pull distances (LP) of thirteen (13) inches to nineteen and one-half (19.5) inches and because the crossbow 100 of the present invention can have extreme bullpup distances (EBP) of the crossbow 100 of more than six (6) inches to eight (8) inches, the crossbow 100 of the present invention is capable of having ratios of length of pull distance (LP) to extreme bullpup distance (EBP) of three and one-quarter-to-one (3.25:1) to one and five-eighths-to-one (1.625:1). The ability to have a ratio of the length of pull distance (LP) to the extreme bullpup distance (EBP) of two-to-one (2:1) or less further provides for a user's ability to hold and support the crossbow 100 for extended periods of time.

Two further advantages of the crossbow 100 are provided in view of the configuration of the foot stirrup 216. Compared to prior art foot stirrups used in crossbows, the downwardly extending U-shaped leg 222 of the foot stirrup 216 provides for increased surface area for a user to step on in order to stabilize the crossbow 100 when the bowstring 210 is cocked. The downwardly extending U-shaped leg 222 of the foot stirrup 216 also allows for the foot stirrup 216 to be used to act as a bipod in order to allow for the forward weight of the crossbow 100 to be supported and stabilized when the crossbow 100 is aimed and fired.

It should also be understood that various modifications could be made to the crossbow 100 that should be considered to be within the scope of the invention as the description of the crossbow 100 was described and illustrated with regard to a current preferred embodiment of the crossbow 100.

For instance, if desired, the extension 242 of the beam 238 could be outfitted with a mounting rail along its bottom surface 258, or even along its side surfaces. Alternatively, the extension 242 of the beam 238 could be provided without any mounting rails at all, so long as accessories could still be mounted to the extension 242 of the beam 238 itself in some manner.

As another example, the base 240 of the beam 238 is described and illustrated as having a pair of legs 248, 250 which are spaced from one another and which are secured to the right and left side portions 140, 142 of the riser 106, respectively. If desired, one of these legs 248, 250 could be removed from the base 240 of the beam 238 such that the base 240 of the beam 238 only has a single contact point with the riser 106. Conversely, the base 240 of the beam 238 could have three or more legs which are separated from one another and which are secured to different portions of the riser 106. Thus, the exact configuration of the base 240 of the beam 238 can be configured in any manner desired so long as the configuration of the base 240 of the beam 238 does not interfere with either the path of travel of a bolt which has been fired by the crossbow 100 or with the movement of the bowstring 210 from its rearward cocked position to its forward rest position.

As an alternative example, neither the base 240 of the beam 238 nor the extension 242 of the beam 238 need to be positioned to extend over the top wall 121 of the upper portion 112 of the barrel 104. Rather, the extension 242 of the beam 238 (and thus at least a portion of the base 240) could be offset from being positioned over the top wall 121 of the upper portion 112 of the barrel 104. In the case where the extension 242 is secured to the trigger box 174 of the firing assembly 172, the beam 238 may, for example, generally curve from its connection to the riser 106 to its connection to the trigger box 174. Alternatively, the beam 238 may, for example, generally angle/curve outwardly from its connection to the riser 106, then extend rearward in parallel, but offsetting relation, to the barrel 104, and then generally angle/curve inwardly to its connection with the trigger box 174. In the case where the extension 242 is not secured to the trigger box 174 of the firing assembly 172, the beam 238 may, for example, generally curve from its connection to the riser 106 to the rearward end 254 of the extension 242 or the beam 238 may, for example, generally angle/curve outwardly from its connection to the riser 106 and then extend rearward to the rearward end 254 of the extension 242 in parallel, but offsetting relation, to the barrel 104. If desired, the beam 238 could be provided with two or more extensions, where either one or none of the extensions extends over the top wall 121 of the barrel 104, and where none or any of the extensions is secured to the trigger box 174 of the firing assembly 172. Furthermore, if desired, two separate beams 238 could be provided where the bases 240 thereof contact the riser 106 at different locations, with a single leg or multiple legs, and then have extensions 242 extending generally rearward therefrom. The extensions 242 may also, if desired, not extend rearward, but may extend to the right or to the left (generally perpendicular to the barrel 104) or even forwardly.

In another example, the extension 242 of the beam 238 could be attached to a rearward portion of the crossbow 100, other than the trigger box 174, for example to the barrel 104 or the stock 108, as long as the extension 242 does not interfere with the travel of either the bowstring 210 or the bolt.

As a further example, it is to be understood that the beam 238 itself could be utilized independent of the crossbow 100 described and illustrated herein. For instance, the beam 238 could be provided to users as an aftermarket accessory which could be secured to a user's existing crossbow. Alternatively, the beam 238 could be designed for particular use with any given specific model of crossbow and sold either together, or separately from, that particular crossbow.

Figure 28:
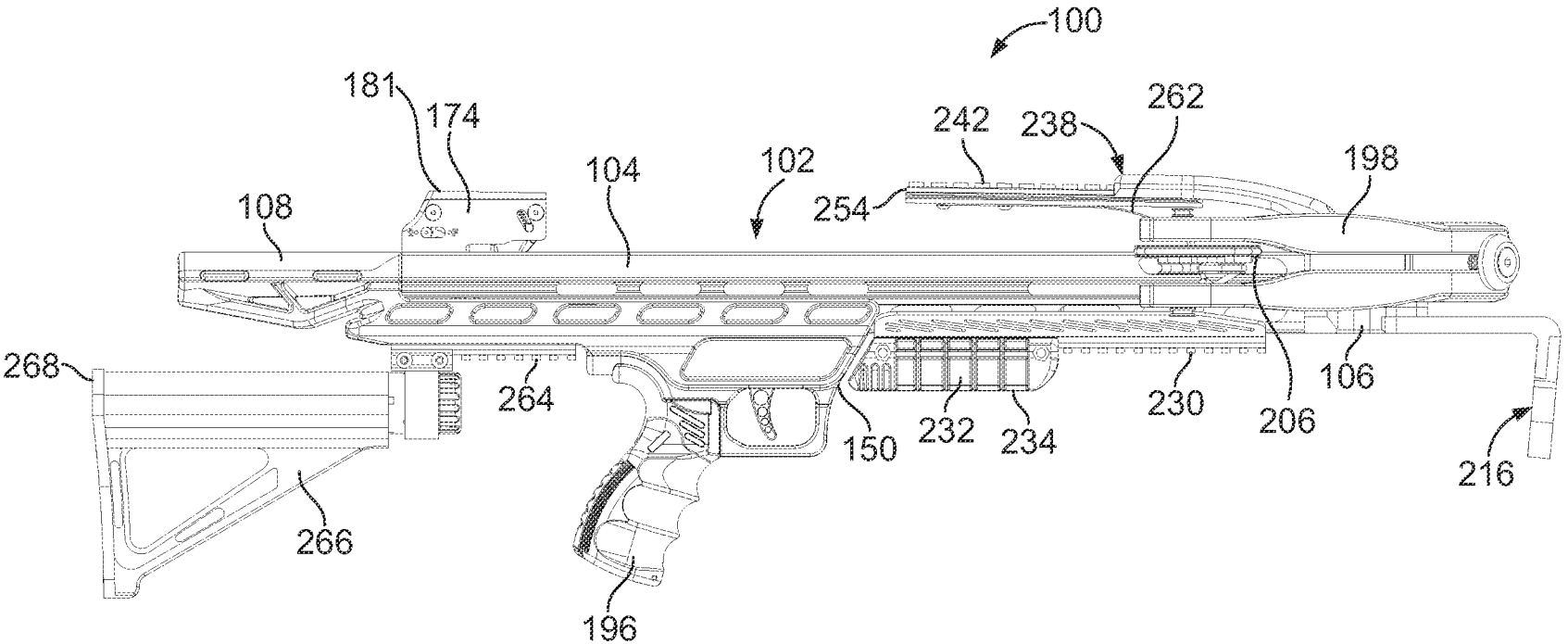
FIG. 28 is a perspective view of an alternative first preferred embodiment of a crossbow of the invention with the bowstring in a forward rest position and having a beam which does not extend to a trigger box of a firing assembly.

In another example, the extension 242 of the beam 238 does not need to extend a distance which allows it to be secured to the trigger box 174 of the firing assembly 172. Rather, as illustrated in FIG. 28, the rearward end 254 of the extension 242 may be a free end which is distanced from the trigger box 174 of the firing assembly 172, such that the beam 238 is generally cantilevered from its forward end which is secured to the riser 106. The length of the extension 242 would still preferably be long enough such that a sighting device could be mounted on the extension 242. This configuration of the beam 238 could be advantageous if the beam 238 is sold as an aftermarket accessory as the beam 238 would then more easily be secured to a user's existing crossbow when the user doesn't have to worry about having a particularly appropriately-sized beam 238.

As another example, the crossbow 100 described and illustrated is of a type that is commonly referred to as a traditional compound crossbow. It is to be understood that the improvements described hereinabove with regard to the crossbow 100 could also be implemented in alternative compound crossbows, such as reverse-draw crossbows, or in recurve crossbows. In reverse-draw crossbows, the riser is provided proximate a rear end of the barrel and the limbs extend outwardly therefrom with the limb tips being provided forward of the connection of the limbs to the riser. In such a reverse-draw crossbow, the beam 238 could still be provided, and would still provide the same benefits and advantages as the beam 238 of crossbow 100, but rather than the beam 238 being secured to the riser, the beam 238 would be secured to a forward portion of the barrel (or to some portion of the crossbow that is positioned proximate the forward end of the barrel). In any event, the beam 238 would be secured in position forward of the forward rest position of the bowstring. In recurve crossbows, the crossbows are not outfitted with the pulleys and cables and the bowstring extends directly from one limb tip to the opposing limb tip. Thus, the benefits of the improvements described and illustrated in relation to a traditional compound crossbow would also equally apply to a recurve crossbow.

In another example, the butt member 266 could be fixed in position along the bottom surface 156 of the forward end portion 153 of the stock 108, rearward of the finger-pull mechanism 180 and the grip 196. Furthermore, the butt member 266 could be integrally formed with the forward end portion 153 of the stock 108, rearward of the finger-pull mechanism 180 and the grip 196.

In yet another example, the forearm 232 and/or the foregrip could be fixed in position along the bottom wall 116 of the barrel 104. The foregrip could also be fixed in position, for example a position which is generally perpendicular to the barrel 104, such that it is not movable between different angular positions.

The crossbow 100 could also be formed as a "rail-less" crossbow, essentially meaning that a bolt does not travel within or slide along a rail as it is fired by the crossbow 100. In order to provide a "rail-less" crossbow, the configuration of the barrel 104 and the riser 106 would need to be slightly modified, and a rest member would need to be provided to support a forward end of the bolt, which would likely be positioned on the riser 106 or the barrel 104, proximate to the forward end 110 thereof. The rearward end of the bolt would be supported in the same manner as described hereinabove, namely with the nock of the bolt being engaged by the bowstring 210.

In another example, the manner in which the sighting device 270 is mounted to the beam 238/mounting rail 244 could be altered such that the eyepiece 272 of the sighting device 270 is not positioned directly over the barrel 104. Rather, the sighting device 270 could be outfitted with an angular mount which would allow the sighting device 270 to be mounted to the mounting rail 244, but which would offset the sighting device 270 relative to the barrel 104. Such an angularly-mounted sighting device 270 may be advantageous to a user when using the crossbow 100, or one of its general type, namely where one or more of the following are provided, a bullpup stock 108, an adjustably positioned butt member 266, and a beam 238. These items allow for the user to bring the center of gravity of the crossbow 100 rearward and closer to a user's body when aiming and firing, however, because of this, the positioning of the sighting device 270 directly over the barrel 104 and/or the trigger box 174 may not be in the optimal position for the sighting device 270. For example, due to the position of the trigger box 174, the user may have trouble looking through the sighting device 270 when aiming and firing. For instance, the configuration of a parts of the crossbow provided at a rear portion thereof may prevent a particular user for easily or comfortably looking through the eyepiece 272 of the sighting device 270. By providing an angularly-mounted sighting device 270, the user may improve his/her comfort and/or ability to look through the sighting device 270 when aiming and firing.

In another example, the provision of the beam 238 allows for alternative devices to hold the bolt in place instead of the retention spring(s) 262. For instance, one or more tension-loaded balls could extend downwardly from the bottom surface 258 of the extension 242 of the beam 238 at any desired position. The tension-loaded ball provides downward tension toward the bolt.

In yet another example, the stock 108 may be provided without the rearward end portion 154 thereof (e.g., where a cocking winch of the type described in United States Patent Publication No. US 2009/0277435 A1 is not to be used) such that the rearward end 111 of the barrel 104 does not abut against any portion of the stock 108. In this configuration, the rearward end 111 of the barrel 104 may be in alignment with, or extend rearward of, the forward end portion 153 of the stock 108.

In still another example, the configuration of the barrel 104 may be altered to allow for the trigger box 174 to be positioned at a location which is further forward of the rearward end 111 of the barrel 104 than as shown and described herein.

Figure 29:
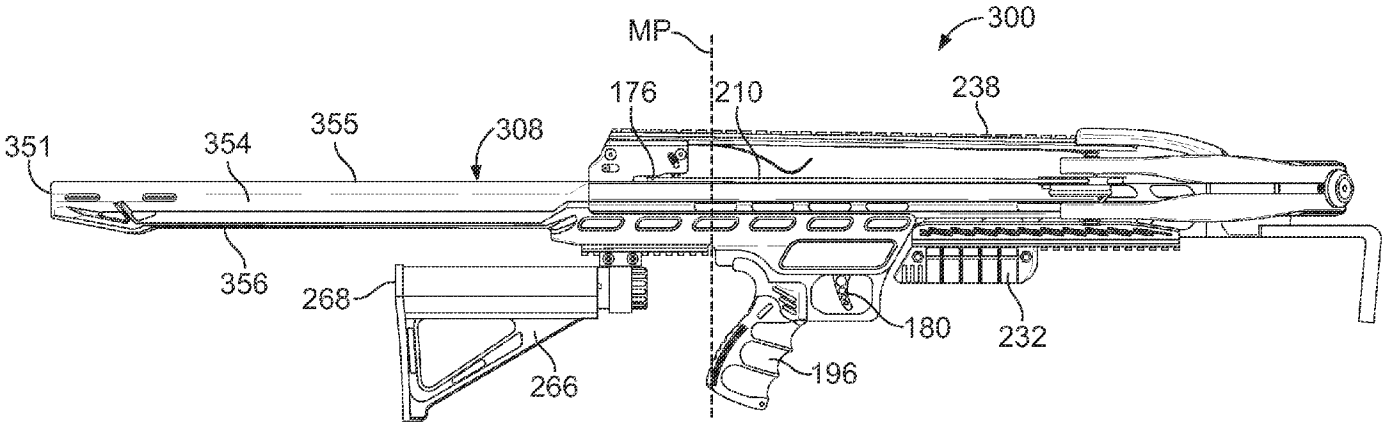
FIG. 29 is a right side view of a second preferred embodiment of a crossbow of the invention, which is generally identical to the crossbow as illustrated in FIG. 1, but which includes an elongated rearward member.
Figure 30:
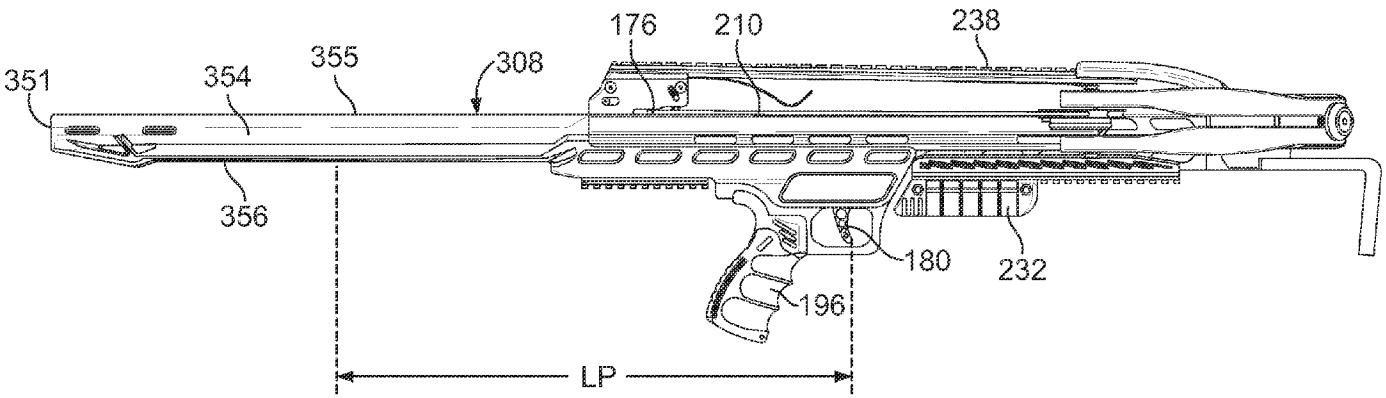
FIG. 30 is a right side view of an alternative second preferred of a crossbow of the invention, which is identical to the crossbow as illustrated in FIG. 29, but which does not include a butt member.

Attention is now directed to FIGS. 29 and 30 and the second embodiment of the crossbow 300. The crossbow 300 is similar to the crossbow 100 and, therefore, only the structure of the crossbow 300 that varies from the crossbow 100 will be described in detail hereinbelow. All structure in the description of the crossbow 300 provided hereinbelow that is identical to the structure in the description of the crossbow 100 provided hereinabove will not be again described, but rather will be referenced with regard to the reference numerals in the one and two hundreds of the crossbow 100.

As illustrated in FIG. 29, the crossbow 300 is generally identical to the crossbow 100, with the exception that the stock 308 of the crossbow 300 is different in configuration from the stock 108 of the crossbow 100. More specifically, the stock 308 is preferably identical to the stock 108, with the exception that the stock 308 has an elongated rearward end portion 354 of the stock 308. The elongated rearward end portion 354 of the stock 308 has a top surface 355, and bottom surface 356 and rearward end 351. The elongated rearward end portion 354 of the stock 308 preferably does not have a slot provided therein which is accessible via the rearward end 351 of the stock 308.

The rearward end 351 of the stock 308 is defined as the rearward end of the crossbow 300 as the elongated rearward end portion 354 of the stock 308 extends rearward relative to the butt end 268 of the butt member 266 (regardless of whether it is positionally adjustable or fixed in positioned. While the butt end 268 of the butt member 266 remains configured to abut against a front of a user, typically a torso of the user proximate to the user's shoulder, when the crossbow 100 is aimed and fired, the bottom surface 356 of the elongated rearward end portion 354 of the stock 308 is configured to extend past a user's shoulder and, in a preferred embodiment, a portion of the bottom surface 356 of the elongated rearward end portion 354 is configured to be positioned against, and to rest upon, a top of the user's shoulder. The rearward end 351 of the stock 308 is preferably positioned a distance from the butt end 268 of the butt member 266 that allows for the rearward end 351 of the stock 308 to be positioned rearward of the front of the shoulder of the user when the crossbow 100 is aimed and fired. If desired, the portion of the bottom surface 356 of the elongated rearward end portion 354 that is configured to be positioned against, and to rest upon, a top of the user's shoulder could be provided with some type of cushioning or padding.

In order to use the crossbow 300, the user would cock the bowstring 210 and position a bolt on the crossbow 300 (in the same general manner described hereinabove with regard to crossbow 100). With the bowstring 210 provided in its cocked position and the bolt being engaged with the bowstring 210 and positioned within the rail of the crossbow 300, a user can ready him or herself for firing the crossbow 300. The user will thus position the butt end 268 of the butt member 266 against his/her torso, proximate to his/her right shoulder (description is provided for a right-handed user, with the understanding that the positioning would typically be reversed for a left-handed user). Positioning the butt end 268 of the butt member 266 in this manner allows the user to steady a rear portion of the crossbow 300, and also allows for the minimization of any recoil or kick of the crossbow 300 (recoil or kick of a crossbow 300 is typically minimal and non-noticeable) upon firing. With this positioning of the butt end 268 of the butt member 266, the portion of the bottom surface 356 of the elongated rearward end portion 354 of the stock 308 will rest upon the user's right shoulder. Positioning of the bottom surface 356 of the elongated rearward end portion 354 of the stock 308 in this manner allows the user to further steady a rear portion of the crossbow 300, and also allows for the user's shoulder/body to support the rearward weight of the crossbow 300.

The user's right hand would then hold the grip 196 such that one of the user's fingers on his/her right hand, typically, the index finger, is positioned around the finger-pull mechanism 180. Positioning the user's right hand in this manner allows the user to support the forward weight of the crossbow 300 (which is easier to do since the user's shoulder/body essentially supports all or a substantial portion of the rearward weight of the crossbow 100) and to pull the finger-pull mechanism 180, which causes the string latch 176 to release the bowstring 210 so that it is propelled forward from its cocked position to its rest position, which in turn causes the bolt to be fired from the crossbow 300. The user could then, optionally, also be able to use either his/her left arm or left hand, as desired to further support the forward weight of the crossbow 300, by engaging the forearm 232 or the foregrip. Because of the user's ability to support the weight of the crossbow 300 on his/her shoulder as well as with the grip 196, the user does not necessarily need to use his/her left arm/hand (or any other device used for this purpose) to support the forward weight of the crossbow 300.

The crossbow 300 provides all of the same advantages over crossbows of the prior art as does the crossbow 100. The crossbow 300 also provides at least the following further advantages over crossbows of the prior art.

The provision of the elongated rearward end portion 354 of the crossbow 300 adds to the rearward weight to the crossbow 300 such that the center of gravity of the crossbow 300 is positioned rearward of the center of gravity of the crossbow 100. As the center of gravity of the crossbow 300 is moved closer to a user's body, it is easier for a user to support, aim and balance the crossbow 300, especially over an extended period of time, even despite the extra weight provided to the crossbow 300 due to the elongation of the rearward end portion 354.

The provision of the elongated rearward end portion 354 of the crossbow 300 also makes it easier for a user to balance and support the crossbow 300, regardless of the extra rearward weight it adds to the crossbow 300, because the user is now able to support a substantial portion of the weight of the crossbow 300 due to the elongated rearward end portion 354 of the crossbow 300 being positioned on, and resting upon, a user's shoulder. Thus, the user's torso is doing most of the work to support and balance the crossbow 300 in position, and the user's hand which is holding the grip 196 and pulling the finger-pull mechanism 180, do not support nearly as much of the weight of the crossbow 300, thereby allowing the user to keep the crossbow 300 at the ready in an aiming position for a longer period of time.

Due to the configuration of the crossbow 300, the finger-pull mechanism 180 of the crossbow 180 may be positioned at, or forward of, a midway point (MP) between a forward and rearward end of the crossbow 300. The ability to have the finger-pull mechanism 180, and thus the grip 196, provided at, or forward of, the midway point (MP) of the crossbow 300, further provides for a user's ability to hold and support the crossbow 300 for extended periods of time.

It should also be understood that various modifications could be made to the crossbow 300 that should be considered to be within the scope of the invention as the description of the crossbow 300 was described and illustrated with regard to a current preferred embodiment of the crossbow 300. These modifications include those described hereinabove with regard to crossbow 100, but also include further modifications.

For instance, if desired, a mounting rail (not shown) could be added to the surfaces of the elongated rearward end portion 354 of the stock 308. The mounting rail would be configured to enable typical crossbow accessories to be mounted thereon. The mounting rail would preferably be a Picatinny rail or a Weaver rail, both of which are well-known in the art. The mounting rail could be integrally formed with the surfaces of the elongated rearward end portion 354 of the stock 308.

Figure 31:
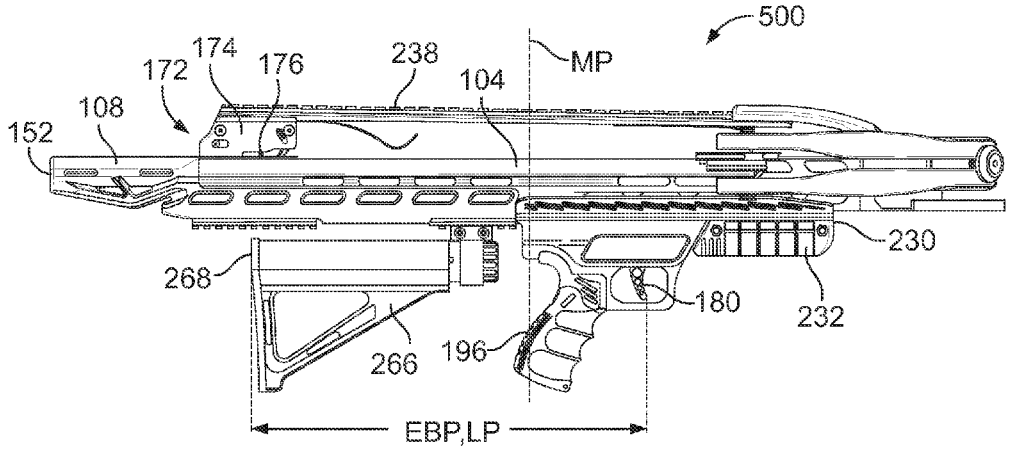
FIG. 31 is a right side view of a third preferred embodiment of a crossbow of the invention, which is generally identical to the crossbow as illustrated in FIG. 2, but which has a finger-pull mechanism of a firing assembly positioned closer to a forward end of the crossbow, such that a bullpup distance of the crossbow is greater than the bullpup distance of the crossbow as illustrated in FIG. 2.

In another example, the butt member 266 could be entirely removed from the crossbow 300, as illustrated in FIG. 30. As the crossbow 300 is configured such that a portion of the bottom surface 356 of the elongated rearward end portion 354 of the stock 308 can allow the user to steady and balance a rear portion of the crossbow 300 upon firing, and because the crossbow 300 has minimal or non-noticeable recoil or kick, the butt member 266 does not need to be present in the crossbow 300 for the crossbow 300 to be suitably and safely operated by a user. Removal of the butt member 266 from the crossbow 300 would reduce the weight of the crossbow 300. It is also to be noted that the length of pull distance (LP) has been defined herein based on the positioning of the butt end 268 of the butt member 266. However, when the butt member 266 is removed from the crossbow 300, this obviously no longer applies, but the length of pull distance (LP) in such a crossbow 300 should be understood to mean the distance from the finger-pull mechanism 180 to a forward-most position where the elongated rearward end portion 354 of the stock 308 hits against the user's body. FIG. 31 illustrates such a representative length of pull distance (LP).

In another example, the elongated rearward end portion 354 of the stock 308 could have a downwardly extending flange portion which defines the rearward end 351 of the stock 308. In use, the user would still rest the portion of the bottom surface 356 of the elongated rearward end portion 354 of the stock 308 on his/her shoulder in order to support the weight of the crossbow 300, but the downwardly extending flange portion of the elongated rearward end portion 354 of the stock 308 would further extend behind a back of the user. This downwardly extending flange portion would allow for further steadying of the crossbow 300 when it is aimed and fired if it is in abutment with the user's back. The inclusion of the downwardly extending flange portion could be used in conjunction with the butt member 266, or could be used in place of the butt member 266.

It should be understood that the elongated rearward end portion 354 of the stock 308 could be provided for in connection with any other prior art crossbow design. Aftermarket accessories which would allow for prior art crossbows to be converted into shoulder-fired weapons such as crossbow 300 could further be marketed.

Figure 32:
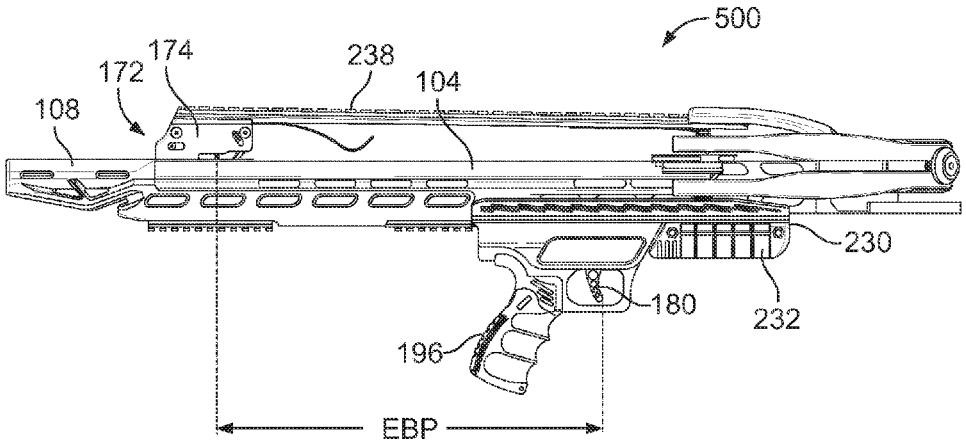
FIG. 32 is a right side view of an alternative third preferred embodiment of a crossbow of the invention, which is identical to the crossbow as illustrated in FIG. 31, but which does not include a butt member.

Attention is now directed to FIGS. 31 and 32 and the third embodiment of the crossbow 500. The crossbow 500 is similar to the crossbow 100 and, therefore, only the structure of the crossbow 500 that varies from the crossbow 100 will be described in detail hereinbelow. All structure in the description of the crossbow 500 provided hereinbelow that is identical to the structure in the description of the crossbow 100 provided hereinabove will not be again described, but rather will be referenced with regard to the reference numerals in the one and two hundreds of the crossbow 100.

The crossbow 500 has the same overall length as the crossbow 100 and is generally identical to the crossbow 100, with the following exceptions. The finger-pull mechanism 180 is positioned closer to a forward end 110 of the barrel 104. More specifically, the finger-pull mechanism is positioned at or forward of, a midway point (MP) between a forward and rearward end of the crossbow 500, As a result, the gripping member 196 is also moved forward. In order to maintain a length of pull distance (LP) which is similar to the length of pull distance (LP) of the crossbow 100, the butt end 268 is also moved forward. As a result, the crossbow 500 is configured to have an extreme bullpup distance (EBP) that is greater than eight (8) inches. In order to accommodate the longer distance between the finger pull mechanism 180 and the string latch 176, the linkage 178 of the firing assembly 172 is lengthened Obviously, making such a change to the firing assembly 172 will require further modifications to the crossbow 500. For instance, one modification that would need to be made is the reduction of the length of the mounting rail 230. A reduction in the length of the mounting rail 230 would result in a reduction in the number of accessories that can be attached thereto, as illustrated in FIG. 31 where only a forearm 232 is provided. Another modification would be the lengthening of the mounting rail 264.

Due to the extreme bullpup distance (EBP) provided by the crossbow 500, the user would now admittedly encounters the problem of having his/her head/neck/face coming into contact with the bowstring 210 or trigger box 174 of the crossbow 500. In order to protect a user's head/neck/face when utilizing the crossbow 500, the crossbow 500 could be outfitted with an adjustable guard that would be secured to one or more of the beam 238, the trigger box 174, the barrel 104 and the stock 108. The connection of the adjustable guard, as well as the adjustable guard itself, could be positioned anywhere along the crossbow 500 so long as it does not interfere with either the path of the bolt being fired from the crossbow 500 or the movement of the bowstring 201 between the forward rest position and the rearward cocked position. It should be noted that, if desired, the crossbows 100, 300 could also be outfitted with an adjustable guard.

The crossbow 500 provides all of the same advantages over crossbows of the prior art as does the crossbow 100. The crossbow 500 also provides at least the following further advantages over crossbows of the prior art.

The extreme bullpup distance (EBP) of the crossbow 500 provides for the forward weight of the crossbow 500 to be reduced and the rearward weight of the crossbow 500 to be increased (as directly compared to the crossbow 100), such that the center of gravity of the crossbow 500 is also moved rearward.

The ability to have the finger-pull mechanism 180, and thus the grip 196, provided at, or forward of, the midway point (MP) of the crossbow 500, further provides for a user's ability to hold and support the crossbow 500 for extended periods of time.

With the crossbow 500 having an extreme bullpup distance (EBP) of greater than eight (8) inches, the crossbow 500 can be equipped to have a ratio of length of pull distance (LP) to extreme bullpup distance (EBP) of one-to-one (1:1) or less. FIG. 31 illustrates the crossbow 500 as having a ratio of length of pull distance (LP) to extreme bullpup distance (EBP) of one-to-one (1:1). The ability to have a ratio of the length of pull distance (LP) to the extreme bullpup distance (EBP) of two-to-one (2:1) or less and, more specifically of one-to-one (1:1) or less, further provides for a user's ability to hold and support the crossbow 500 for extended periods of time.

Also, due to the desire to have the crossbow 500 have a length of pull distance (LP) that is commensurate with the length of pull distance (LP) of the crossbow 100, the portion of the stock 108 of the crossbow 100 that is provided rearward of the butt end 268 of the butt member 266 essentially acts in a similar manner as the elongated rearward end portion 354 of the stock 308 of crossbow 300, such that the crossbow 500 also enjoys all of the benefits of the crossbow 300, but provides them in a more compact crossbow configuration because of the extreme bullpup distance (EBP) of the crossbow 500.

It should also be understood that various modifications could be made to the crossbow 500 that should be considered to be within the scope of the invention as the description of the crossbow 500 was described and illustrated with regard to a current preferred embodiment of the crossbow 500. These modifications include those described hereinabove with regard to crossbow 100, but also include further modifications.

For instance, if desired, a mounting rail (not shown) could be added to the surfaces of the stock 108 provided rearward of the butt end 268 of the butt member 266. The mounting rail would be configured to enable typical crossbow accessories to be mounted thereon. The mounting rail would preferably be a Picatinny rail or a Weaver rail, both of which are well-known in the art. The mounting rail could be integrally formed with the surfaces of the stock 108.

In another example, and in a manner similar to the crossbow 300 illustrated in FIG. 30, the butt member 266 could be entirely removed from the crossbow 500, as illustrated in FIG. 32.

In another example, the stock 108 could have a downwardly extending flange portion which defines the rearward end 151 of the stock 108.

It should also be noted that, alternatively, the crossbow 500 having the extreme bullpup distance (EBP) could be provided by extending the length of a rearward portion of the barrel 104 such that the trigger box 174 is moved further rearwardly of the finger-pull mechanism 180 (whose position does not change compared to crossbow 100) to achieve the extreme bullpup distance (EBP). Such a configuration of the crossbow 500 would not provide the same benefits as discussed above where the finger-pull mechanism 180 is moved forward of the trigger box 174 (whose position does not change compared to crossbow 100), but rather would provide for a longer barrel length and, therefore, for an increased power stroke. Because of the extreme bullpup distance (EBP), the results of making this change would be an increase in the rearward weight of the crossbow 500 (with minimal to no change in the forward weight of the crossbow 500), such that the center of gravity of such a crossbow 500 would be positioned more rearward than if the barrel length of a prior art crossbow were lengthened, but which did not provide for an extreme bullpup distance (EBP).

While preferred embodiments of the present invention are shown and described, it is envisioned that those skilled in the art may devise various modifications of the present invention without departing from the spirit and scope of the invention.

The invention is claimed as follows:

1. A crossbow comprising:

a frame defining a forward end and a rearward end;

first and second limbs secured to the frame;

a bowstring which extends between the first and second limbs, the bowstring configured to move between a forward rest position and a rearward cocked position;

a firing assembly having a finger-pull mechanism;

a butt member having a rear end; and a beam which is secured to the frame, the beam being positioned to extend over the forward rest position of the bowstring, the beam being configured to allow one or more accessories to be mounted thereon;

wherein a distance between the finger-pull mechanism and the rear end of the butt member defines a length of pull of the crossbow, and wherein the length of pull of the crossbow is positioned forward of the rearward end of the crossbow.

2. The crossbow as defined in claim 1, wherein the rear end of the butt member is configured to abut against a front of a shoulder of a user when the crossbow is aimed and fired.

3. The crossbow as defined in claim 2, wherein the rearward end of the crossbow is configured to be positioned rearward of the front of the shoulder of the user when the crossbow is aimed and fired.

4. The crossbow as defined in claim 1, wherein the finger-pull mechanism is positioned at, or forward of, a midway point between the forward and rearward ends of the crossbow.

5. The crossbow as defined in claim 1, wherein the frame and the butt member are integrally formed.

6. The crossbow as defined in claim 1, wherein the butt member is adjustably mounted to the frame to provide that the butt member is movable along the frame between a forward position and a rearward position.

7. The crossbow as defined in claim 1, wherein the frame has a rearward end portion extending forward from the rearward end, the rearward end portion of the frame configured to rest on the shoulder of the user.

8. The crossbow as defined in claim 1, further comprising a beam having a base and an extension, the base being secured to the frame forward of the forward rest position of the bowstring, the extension being connected to the base, the extension being configured to allow one or more accessories to be mounted thereon.

9. The crossbow as defined in claim 1, wherein the firing assembly is operatively associated with the frame, and wherein the firing assembly has a string latch, the string latch being configured to retain the bowstring in the rearward cocked position.

10. The crossbow as defined in claim 9, wherein the rear end of the butt member is in alignment with, or forward of, the string latch.

11. The crossbow as defined in claim 1, wherein the frame includes a bull-pup stock.

12. The crossbow as defined in claim 11, wherein the bull-pup stock is an extreme bull-pup stock.

13. A crossbow comprising:

a frame having a forward end and a rearward end;

a firing assembly operatively associated with the frame, the firing assembly having a finger-pull mechanism;

first and second limbs secured to the frame;

a bowstring which extends between the first and second limbs, the bowstring configured to move between a forward rest position and a rearward cocked position; and a butt member adjustably mounted to the frame to provide that the butt member is movable along the frame between a forward position and a rearward position, the butt member having a rear end, wherein a distance between the finger-pull mechanism and the rear end of the butt member defines a length of pull of the crossbow, and wherein the length of pull of the crossbow is positioned forward of the rearward end of the frame.

14. The crossbow as defined in claim 13, wherein the finger-pull mechanism is positioned at, or forward of a midway point between the forward and rearward ends of the frame.

15. The crossbow as defined in claim 13, further comprising a beam having a base and an extension, the base being secured to the frame forward of the forward rest position of the bowstring, the extension being connected to the base, the extension being configured to allow one or more accessories to be mounted thereon.

16. The crossbow as defined in claim 13, further comprising a beam which is secured to the frame, the beam being positioned to extend over the forward rest position of the bowstring, the beam configured to allow one or more accessories to be mounted therein.

17. The crossbow as defined in claim 16, further comprising a base secured to the beam, the base having a body and first and second legs.

18. The crossbow as defined in claim 17, wherein the first and second legs extend downwardly and forwardly from the body of the base.

19. A crossbow comprising:

a frame defining a forward end and a rearward end;

a firing assembly having a finger-pull mechanism;

a butt member adjustably mounted to the frame to provide that the butt member is movable along the frame between a forward position and a rearward position, wherein the butt member has a rear end; and wherein a distance between the finger-pull mechanism and the rear end of the butt member defines a length of pull of the crossbow, and wherein the length of pull of the crossbow is positioned forward of the rearward end of the crossbow.

20. The crossbow as defined in claim 19, further comprising a beam that is secured to the frame, a base that is secured to a forward end of the beam, and a mounting rail that is secured to a top surface of the beam.

* * * * *